US006890260B2

(12) United States Patent
Ollins

(10) Patent No.: US 6,890,260 B2
(45) Date of Patent: May 10, 2005

(54) ILLUMINATED PLAYER TRACKING CARD FOR A GAMING APPARATUS

(75) Inventor: Richard Ollins, Las Vegas, NV (US)

(73) Assignee: IGT, Reno, NV (US)

( * ) Notice: Subject to any disclaimer, the term of this patent is extended or adjusted under 35 U.S.C. 154(b) by 89 days.

(21) Appl. No.: 10/041,196

(22) Filed: Jan. 8, 2002

(65) Prior Publication Data

US 2003/0130042 A1 Jul. 10, 2003

(51) Int. Cl.[7] ..... A63F 9/24
(52) U.S. Cl. ..... 463/29; 463/31; 385/123
(58) Field of Search ..... 463/29, 31, 42; 385/123, 124, 125, 126, 127; 235/382, 380

(56) References Cited

U.S. PATENT DOCUMENTS

| | | | | |
|---|---|---|---|---|
| 3,728,521 A | | 4/1973 | Borough et al. | 235/61.12 |
| 4,710,614 A | | 12/1987 | Camus | 235/380 |
| 4,916,296 A | | 4/1990 | Streck | |
| 5,393,057 A | | 2/1995 | Marnell, II | 273/85 CP |
| 5,702,304 A | | 12/1997 | Acres et al. | |
| 5,770,533 A | | 6/1998 | Franchi | 463/42 |
| 5,789,733 A | | 8/1998 | Jachimowicz et al. | |
| 5,881,196 A | | 3/1999 | Phillips | 385/127 |
| 5,975,728 A | | 11/1999 | Weyer | |
| 5,988,501 A | | 11/1999 | Murakami et al. | 235/454 |
| 5,988,842 A | | 11/1999 | Johnsen et al. | |
| 6,001,016 A | * | 12/1999 | Walker et al. | 463/42 |
| 6,070,998 A | | 6/2000 | Jennings et al. | |
| 6,162,122 A | | 12/2000 | Acres et al. | 463/29 |
| 6,231,224 B1 | | 5/2001 | Gamble et al. | |
| 6,641,035 B1 | * | 11/2003 | Predescu et al. | 235/380 |

FOREIGN PATENT DOCUMENTS

| | | |
|---|---|---|
| EP | 0 902 392 A2 | 8/1998 |
| EP | 1 063 622 A2 | 5/2000 |
| GB | 2 099 756 A | 12/1982 |

OTHER PUBLICATIONS

Rankl and Effing, "Handbuch der Chipkarten," *Hanser*, pp. 110–125 (1999).
International Search Report dated May 22, 2003 for PCT/US02/09985.

* cited by examiner

*Primary Examiner*—Derris H. Banks
*Assistant Examiner*—Corbett Coburn
(74) *Attorney, Agent, or Firm*—Marshall, Gerstein & Borun LLP

(57) ABSTRACT

A gaming apparatus is provided which includes a display unit, a value input device, and a card reader having a light generating source and a data reading apparatus. The gaming apparatus also includes a controller having a processor and a memory that is programmed to allow a person to make a wager, to cause a video image representing a casino game to be generated on the display unit, to determine an outcome of the game represented by the video image, to determine a value payout associated with the outcome of the game, and also including a player tracking card disposed in the card reader and having a data storage device; a plurality of card surfaces; and a light transmissive body portion.

47 Claims, 17 Drawing Sheets

FIG. 16
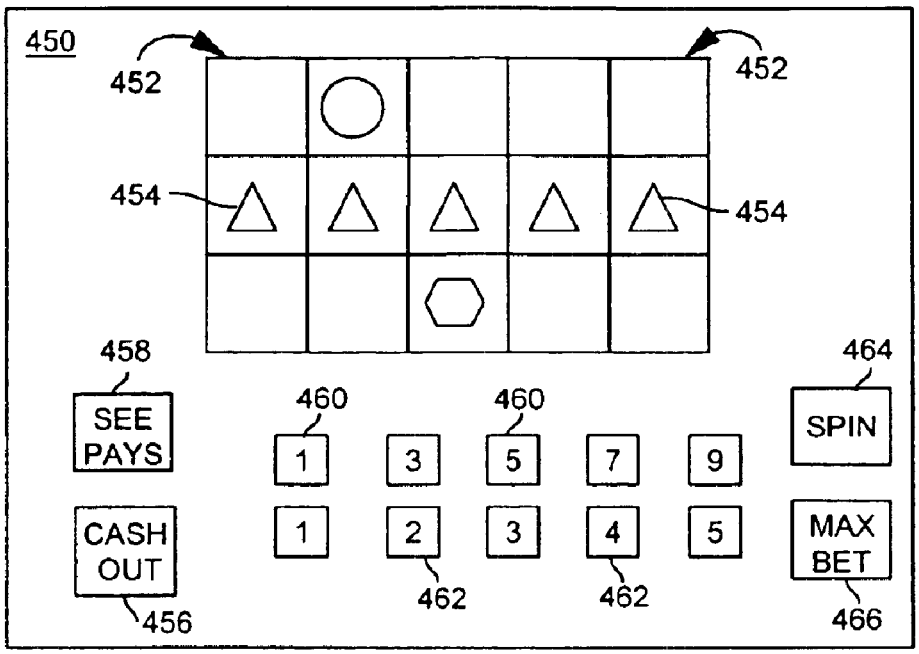
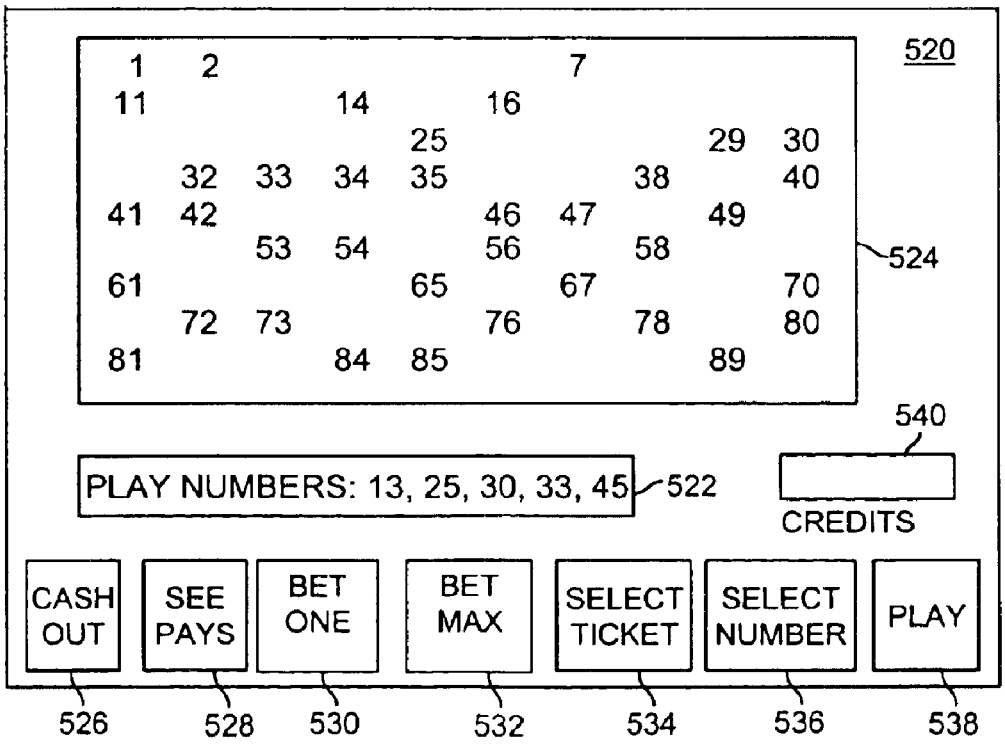
FIG. 17

ILLUMINATED PLAYER TRACKING CARD FOR A GAMING APPARATUS

BACKGROUND OF THE INVENTION

The present invention is directed to an illuminated player tracking card for use with a lottery or gaming apparatus, which could be either an individual gaming apparatus or a gaming system having a plurality of gaming apparatuses.

A gaming apparatus allows a customer of a casino or other facility to play one or more games, such as poker, blackjack, slots, keno, and bingo. A customer typically approaches a gaming unit, and selects a desired game from the games offered on the gaming unit. Upon selection of the desired game, that game appears on the gaming unit, at which time the customer is allowed to play.

During play, the customer places a bet and proceeds with the selected game. For example, where the customer is playing slots, a lever may be pulled to spin the reels. The reels then stop on various symbols, which determines the customer's payout for that spin, after which the customer may place another wager and proceed as discussed above. Where the customer has selected to play blackjack or poker, the player may hit a "deal card" button to deal out the cards for the respective card game. The customer may alter his wager during the particular hand based on which cards are dealt, and in some card games, replace cards, or continue to request cards. After all replacements and/or requests are made, a payout is determined, and the player may continue by placing another wager and playing a new hand.

When a player uses the lottery or gaming apparatus, it is advantageous for personnel of the casino or other facility to be able to observe the status of the gaming apparatus, the status of the game that is being played by the player, and perhaps obtain information about the player. It is advantageous to obtain this information by viewing a pattern of illumination of a plurality of lights. It is further advantageous to use the illumination of the lights to attract players to a particular gaming apparatus. Previous attempts to accomplish this have resulted in locating the lights so that they are viewed directly from the gaming apparatus. This approach however has proven to have limited success in attracting and encouraging players to use particular gaming apparatuses.

SUMMARY OF THE INVENTION

The invention is directed to an apparatus that may comprise a gaming apparatus with a housing and a display unit that is associated with the housing and is capable of generating video images. The gaming apparatus also includes a value input device that is capable of allowing the player to deposit a medium of value. Additionally, the gaming apparatus may comprise a card reader may having a light generating source that is associated with the card reader and a data reading apparatus that is also associated with the card reader. The gaming apparatus may also comprise a controller, wherein the controller is operatively coupled to the display unit, the value input device, and the card reader. The controller may have a processor and a memory operatively coupled to the processor. Additionally, the controller may be programmed to allow a person to make a wager and to cause a video image to be generated on the display unit after the value input device detects deposit of value by the person.

The video image may represent a game selected from the group of games consisting of video poker, video blackjack, video slots, video keno and video bingo, in which case the video image may comprise an image of at least five playing cards if the game comprises video poker. Likewise, the video image may comprise an image of a plurality of playing cards if the game comprises video blackjack. If the game selected by the player is video slots, the video image may comprise an image of a plurality of simulated slot machine reels. The video image may comprise an image of a plurality of keno numbers if the game comprises video keno, or the video image may comprise an image of a bingo grid if the game comprises video bingo. The controller may also be programmed to determine an outcome of the game represented by the video image and a value payout associated with the outcome of the game.

The apparatus may also include a player tracking card that may be disposed in the card reader. The player tracking card may comprise a data storage device that stores data representing the identification of a player. Additionally, the player tracking card may comprise a first card surface, a second card surface, and a light transmissive body portion extending between the first card surface and the second card surface. The player tracking card may be positioned in a card illumination position wherein the first card surface is disposed in the card reader so that the first card surface is positioned adjacent the light generating source associated with the card reader, and the second card surface of the player tracking card remains visible outside the card reader. Also, when said player tracking card is in the card illumination position, light generated by the light generating source may be transmitted into the first card surface of the player tracking card and then transmitted through the light transmissive body portion of the player tracking card so that light may be visible to the user through the second card surface.

The features and advantages of the present invention will be apparent to those of ordinary skill in the art in view of the detailed description of various embodiments, which is made with reference to the drawings, a brief description of which is provided below.

BRIEF DESCRIPTION OF THE DRAWINGS

FIG. 16 is an illustration of an embodiment of a visual display that may be displayed during performance of the slots routine of FIG. 18;

FIG. 17 is an illustration of an embodiment of a visual display that may be displayed during performance of the video keno routine of FIG. 19;

DETAILED DESCRIPTION OF VARIOUS EMBODIMENTS

Figure 1:
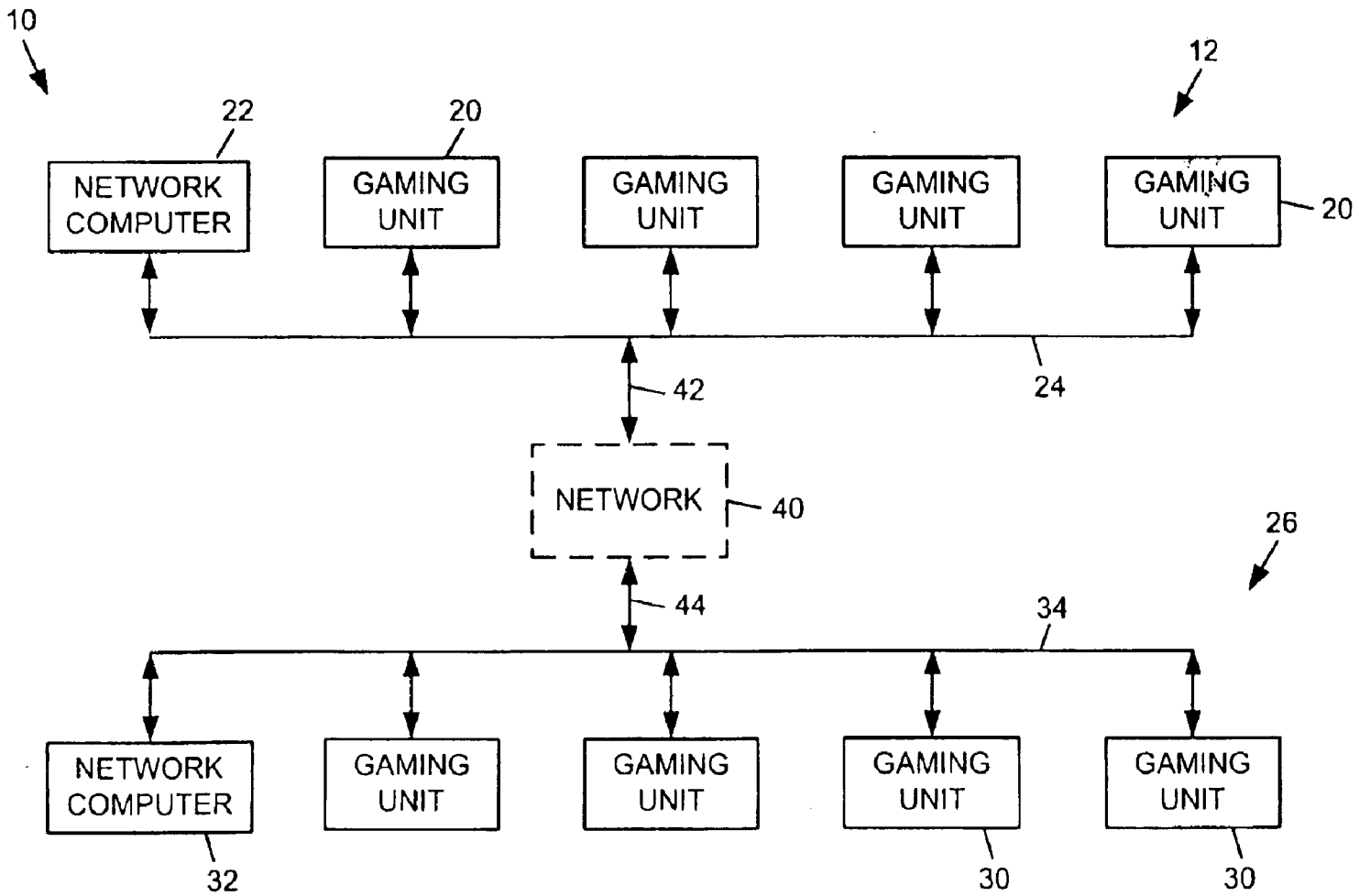
FIG. 1 is a block diagram of an embodiment of a gaming system in accordance with the invention.

FIG. 1 illustrates an embodiment of a gaming system 10 in accordance with the invention. Referring to FIG. 1, the gaming system 10 may include a first group or network 12 of gaming units 20 operatively coupled to a network computer 22 via a network data link or bus 24. The gaming system 10 may include a second group or network 26 of gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44.

The first network 12 of gaming units 20 may be provided in a first casino or facility, and the second network 26 of gaming units 30 may be provided in a second casino or facility located in a separate geographic location than the first facility. For example, the two facilities may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a server computer and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

Figure 2:
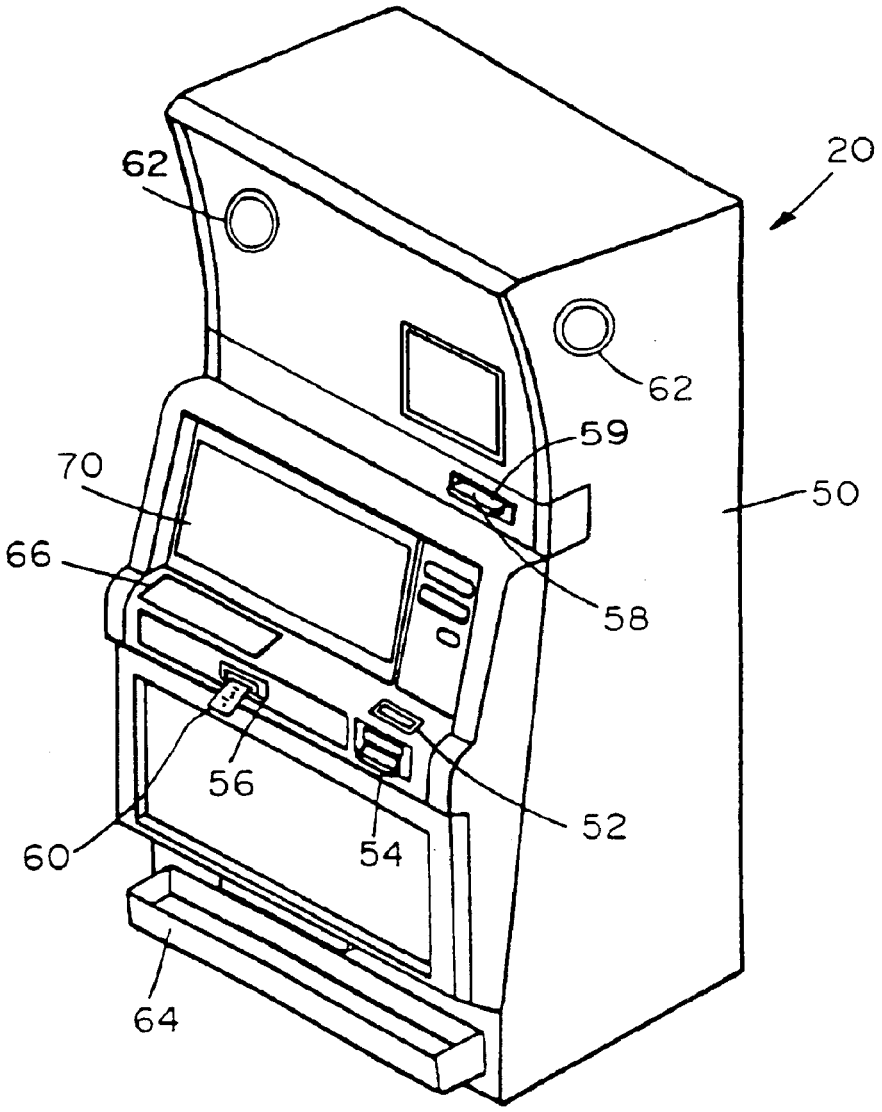
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of gaming unit and may have various different structures and methods of operation. For exemplary purposes, various designs of the gaming units 20 are described below, but it should be understood that numerous other designs may be utilized.

Referring to FIG. 2, the gaming unit 20 may include a housing or cabinet 50 and one or more input devices, which may include a coin slot or acceptor 52, a paper currency acceptor 54, a ticket reader/printer 56 and a card reader 58, which may be used for several purposes, as will be described in detail below. A value input device may include any device that can accept value from a customer. As used herein, the term "value" may encompass gaming tokens, coins, paper currency, ticket vouchers, credit or debit cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items or gaming data printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card 59. If provided for player tracking purposes, the card reader 58 may be used to read gaming data from, and/or write gaming data to, player tracking cards that are capable of storing data representing the identity of a player, the identity of a casino, the player's gaming habits, etc. The card reader 58 may also include additional components that are described in conjunction with FIG. 4.

The gaming unit 20 may include one or more audio speakers 62, a coin payout tray 64, an input control panel 66, and a color video display unit 70 for displaying images relating to the game or games provided by the gaming unit 20. The audio speakers 62 may generate audio representing sounds such as the noise of spinning slot machine reels, a dealer's voice, music, announcements or any other audio related to a casino game. The input control panel 66 may be provided with a plurality of pushbuttons or touch-sensitive areas that may be pressed by a player to select games, make wagers, make gaming decisions, etc.

Figure 2A:
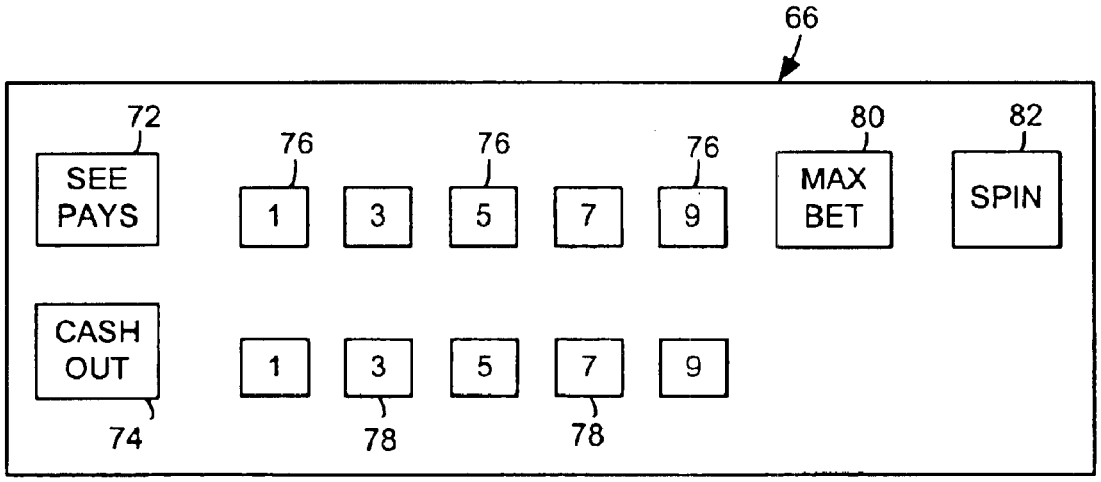
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as: by returning a number of coins to the player via the payout tray 64, printing a ticket 60, or writing information to a card 58.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74, 76, 78, 80, 82. It should be understood that the rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Figure 3:
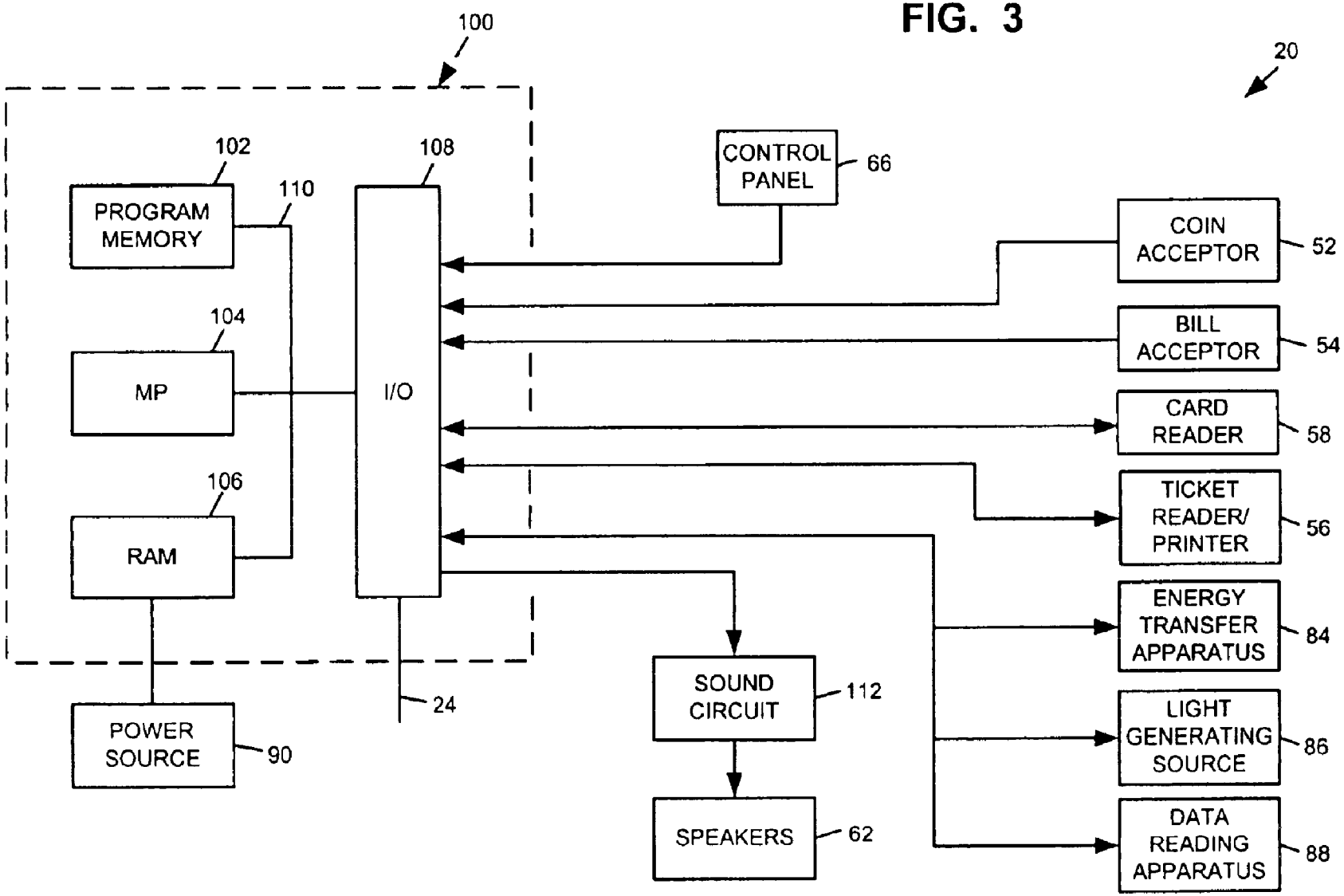
FIG. 3 is a block diagram of the electronic components of the gaming unit of FIG. 2.

The apparatus 20 may also include an energy transfer apparatus 84, a light generating source 86, a data reading apparatus 88, and a power source 90 (see FIG. 3).

Gaming Unit Electronics

FIG. 3 is a block diagram of a number of components that may be incorporated in the gaming unit 20. Referring to FIG. 3, the gaming unit 20 may include a controller 100 that may comprise a program memory 102, a microcontroller or microprocessor (MP) 104, a random-access memory (RAM) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the I/O circuit 108 is shown as a single block, it should be appreciated that the I/O circuit 108 may include a number of different types of I/O circuits. The RAM(s) 106 and program memories 102 may be implemented as semiconductor memories, magnetically readable memories, and/or optically readable memories, for example.

FIG. 3 illustrates that the control panel 66, the coin acceptor 52, the bill acceptor 54, the ticket reader/printer 56, the card reader 58, an energy transfer apparatus 84, a light generating source 86, and a data reading apparatus 88, may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice- and sound-synthesis circuit or that may comprise a driver circuit. The sound-generating circuit 112 may be coupled to the I/O circuit 108. A power source 90 may be utilized to provide electrical power for the controller 100 and the interconnected components 52, 54, 56, 58, 62, 66, 84, 86, 88, and 112.

As shown in FIG. 3, the components 52, 54, 56, 58, 66, 84, 86, 88, and 112 may be connected to the I/O circuit 108 via a respective direct line or conductor. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108.

Figure 4:
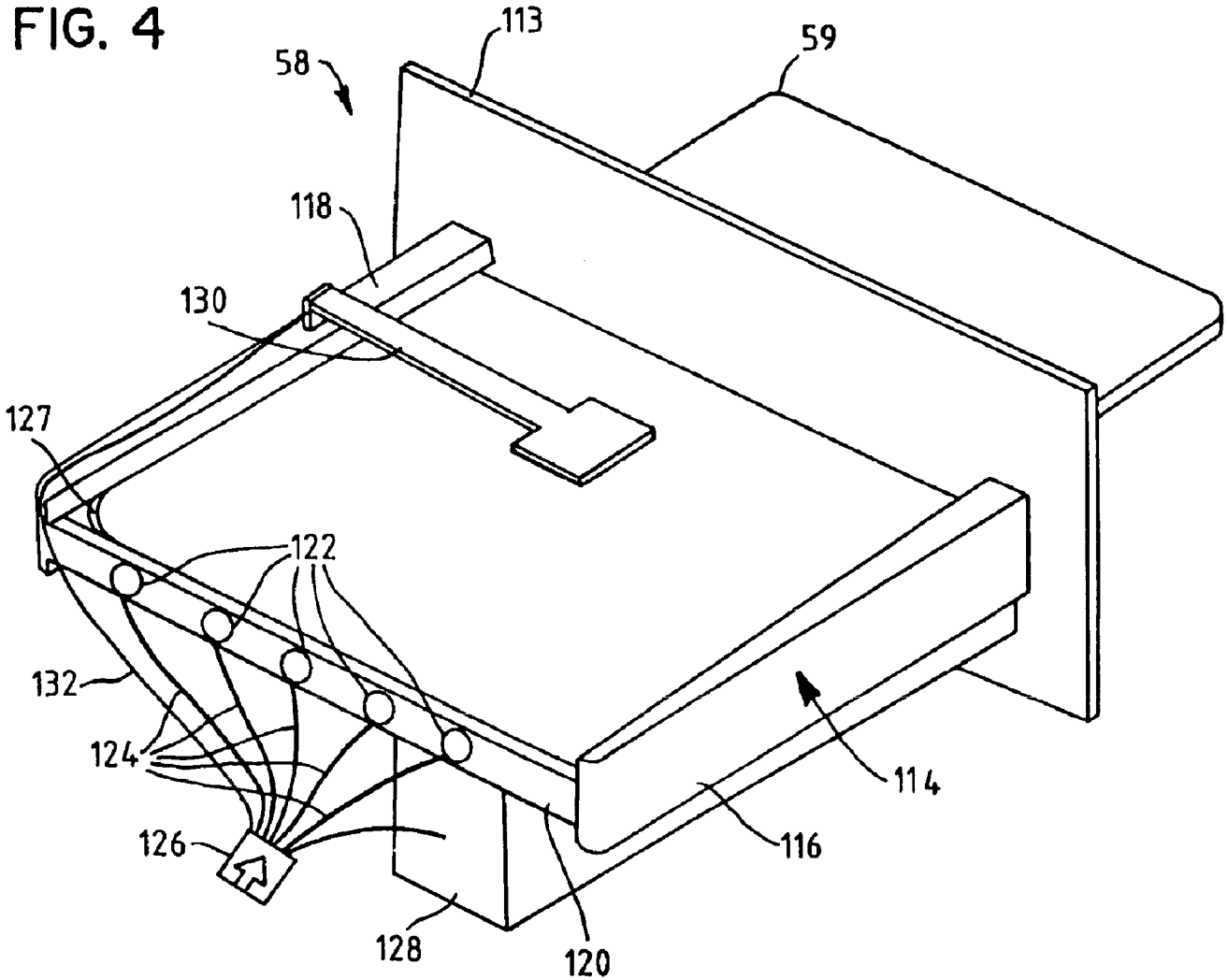
FIG. 4 illustrates schematically an embodiment of a player tracking card disposed in a card reader.

FIG. 4 illustrates schematically an embodiment of a player tracking card 59 disposed in a card reader 58. As will be discussed in more detail below, the player tracking card 59 is positioned in a card illumination position. The card reader 58 may include a mounting plate 113 to assist in securing the card reader 58 to the housing 50 of the gaming apparatus 20. The card reader 58 may also include a chassis 114 which may comprise a first side rail 116, a second side rail 118, and a back structure 120.

The card reader 58 of FIG. 4 may also include a number of light generating sources 122. The light generating sources 122 shown in FIG. 4 are fixed to the back structure 122 of the chassis 114, however the light generating sources 122 may also be secured directly to the housing 50 of the gaming apparatus 20 or any other structure within the housing 50 that is separate from the card reader 58. The light generating sources 122 may comprise LEDs, OLEDs, incandescent lamps, fluorescent lights, or any other device capable of generating light. If a plurality of the light generating sources 122 are used, they may produce light that is uniform in color or they may produce a plurality of different colors. The light generating sources 122 may be connected to the controller 100 through a plurality of corresponding conductors 124 to control the intensity and pattern of illumination of the light generating sources 122. The conductors 124 may be connected to a modular connector 126 for ease of installation into the gaming apparatus 20.

The player tracking card 59 may be positioned in the card illumination position when the card 59 is disposed in the card reader and a first card surface 127 is adjacent the light generating sources 122. In the embodiment shown in FIG. 4, the player tracking card 59 may rest on the side rails 116 and 118 and the first card surface 127 may abut the back structure 120 of the chassis 114 when the player tracking card 59 is in the card illumination position. Thus, when the player tracking card 59 is in the card illumination position, light generated by the light generating sources 122 is transmitted into the first card surface 127 of the player tracking card 59.

A data reading apparatus 128 may also be included in the gaming apparatus to read data from the player tracking card 59 that is disposed in the card reader 58. The data reading apparatus 128 may be attached to the chassis 114 so that it is in close proximity to the player tracking card 59 when the player tracking card 59 is disposed in the card reader 58 and in the card illumination position. The data reading apparatus 128 may read data from the player tracking card 59 in a variety of ways. For example, the data reading apparatus 128 may read data from a magnetic strip or from an optically readable material such as ink, both of which may be located on a surface of the player tracking card 59. It is also possible to utilize multiple data reading apparatuses to read data from additional magnetic strips or optically readable materials located on the same surface or on different surfaces of the player tracking card 59. As another example, the data reading apparatus 128 may utilize an antenna to couple with a corresponding antenna in the player tracking card 59 so that data is thereby transmitted.

The data reading apparatus 128 may be interconnected to the controller 100 so that the data may be stored and possibly acted on, such as by energizing a light generating source 122. While not shown, a data writing apparatus may also be included to write new data to the player tracking card 59. This may be a separate component, or it may be combined with the data reading apparatus 128.

The gaming apparatus 20 may also include an energy transfer apparatus 130. The energy transfer apparatus 130 may be mounted on the second side rail 118 and operatively coupled to the controller 100 through a conductor 132. The energy transfer apparatus 130 may be located in close proximity to a surface of the player tracking card 59 when the player tracking card 59 is disposed in the card reader 58 and positioned in the card illumination position. The energy transfer apparatus 130 may utilize one of many available techniques to transfer energy to the player tracking card 59. For example, the energy transfer apparatus 130 may comprise an antenna or coil having at least one loop or turn. More loops or turns may be utilized to increase the magnetic flux generated, and increase the antenna's range. Additionally, a plethora of antenna designs, both simple and complex, may be utilized to create the desired coupling with a corresponding antenna in the player tracking card 59 (See FIG. 7). This technique is often referred to as inductive coupling by those skilled in the art and is capable of transmitting both power and data between the gaming apparatus 20 and the player tracking card 59.

The energy transfer apparatus 130 may also comprise a first metallic plate to transfer energy to the player tracking card 59. The first metallic plate may correspond to and be aligned with a second metallic plate in the player tracking card 59 (See FIG. 8) when the player tracking card 59 is in the card illumination position. This technique is referred to as capacitative coupling by those skilled in the art, and is capable of transmitting or receiving both power and/or data. The transmission and reception of the power and data may be controlled by the controller 100.

The energy transfer apparatus 130 may also comprise a first conductive port, such as a modular plug, to interconnect with a second conductive port located on the player tracking card 59 (see FIG. 9) when the player tracking card 59 is disposed in the card reader 58 and positioned in the card illumination position. The conductive ports may comprise one or more separate connections to transfer power and/or data between the gaming apparatus 20 and the player tracking card 59. The conductive ports may utilize modular plugs to interconnect wherein one of the conductive ports includes at least one male connector (i.e. a metallic prong or pin) and the other conductive port includes a corresponding number of female connectors (i.e. a metallic receptacle) to mate with the male connector and complete a conductive path for energy transmission. The energy transmissions between the gaming apparatus 20 and the player tracking card 59 may be controlled by the controller 100.

Player Tracking Card Embodiments

Figure 5:
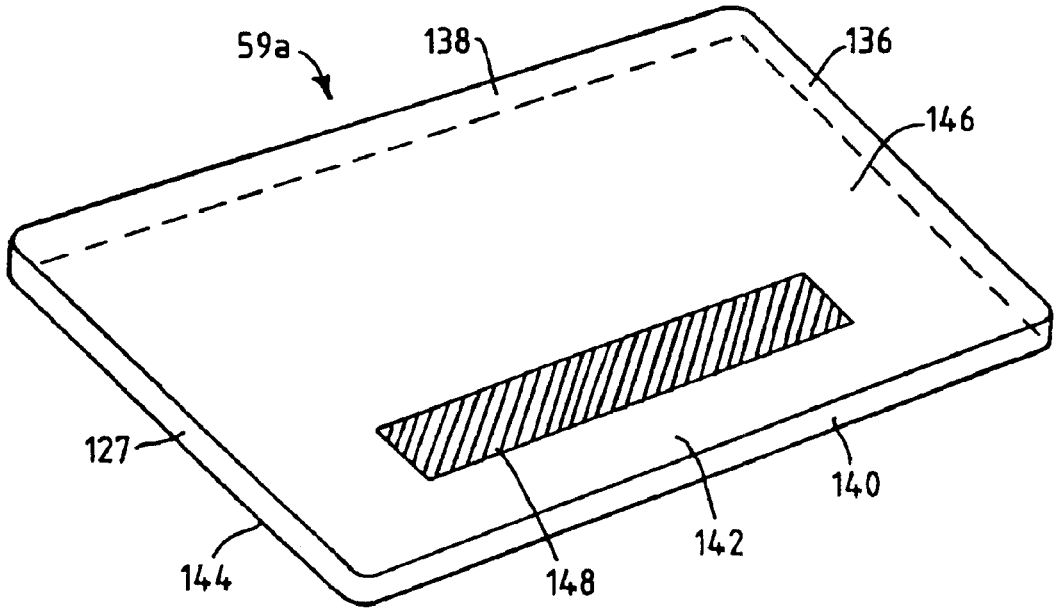
FIG. 5 is a schematic representation of an embodiment of a player tracking card capable of propagating light.

FIG. 5 illustrates one embodiment of a player tracking card 59*a*. The player tracking card 59*a* may include the first card surface 127, a second card surface 136, a third card surface 138, a fourth card surface 140, a fifth card surface 142, and a sixth card surface 144. The second card surface 136 of the player tracking card 59*a* may be generally parallel to and spaced apart from first card surface 127. The player tracking card 59 may also comprise a light transmissive body portion 146 extending between the first card surface 127 and the second card surface 136.

The transmissive body portion 146 may comprise a clear translucent material, a colored material, multi-colored material, or any other material that may be optically "clear" and capable of transmitting or propagating light signals. The player tracking card 59*a* may also have a reflective material or coating disposed on at least a portion of the third through sixth card surfaces 138–144 to enhance the transmission of light from the first card surface 127 to the second card surface 136. The reflective material may be disposed on the card surfaces 138–144 with the use of an adhesive. The player tracking card 59*a* may also have printing, such as advertisement or decoration, disposed on the reflective material, or at least portions of the reflective material.

When the player tracking card 59*a* is positioned in the card illumination position, the first card surface 127 may be disposed in the card reader 58 and the second card surface 136 may remain visible outside the card reader. Thus, when the player tracking card 59*a* is positioned in the card illumination position and the first card surface 127 is located adjacent the light generating sources 122, light generated by the light generating sources 122 may be transmitted into the first card surface 127 of the player tracking card 59*a* and may then be transmitted through the light transmissive body portion 146 of the player tracking card 59*a* so that the generated light is visible to a user through the second card surface 136. If as in FIG. 4, a portion of the player tracking card 59*a* remains exposed from the card reader 58 when the player tracking card 59*a* is in the card illumination position, then light generated by the light generating sources 122 may be visible on the exposed portions of the third, fourth, fifth, and sixth card surfaces 138, 140, 142, and 144.

The player tracking card 59*a* may also have disposed thereon any other type of material other than the reflective material described above that would comprise the physical properties of having a lower index of refraction to enhance internal reflection of light propagating through the light transmissive body portion. Another alternative and simple technique to enhance the light transmission from the first card surface 127 to the second card surface 136 may be to condition the outer surfaces of the light transmissive body portion 146 so that at least a portion of the third through sixth card surfaces 138–144 may comprise a lower index of refraction, thus increasing the amount of internally reflected light and improving the performance of the player tracking card 59*a*.

By transmitting light through the transmissive body portion 146 of the player tracking card 59*a* and making it visible on at least a portion of the exposed player tracking card 59*a*, information such as player status and machine status may be communicated to the player and other employees of the facility owning the gaming apparatus 20. This may be accomplished by producing varying or repeating patterns of color and/or intensity of the light visible through the player tracking card 59.

The player tracking card 59*a* of FIG. 5 may also include a data storage device that stores data representing the identification of a player. Many different types of devices to store data may be suitable. FIG. 5 illustrates a magnetic strip 148 on the fifth card surface 142. The location of the magnetic strip 148 on the player tracking card 59*a* is not important and may be located in a variety of places and comprise a variety of different shapes. The magnetic strip 148 may be aligned with the data reading apparatus 128 so that the information read may be transmitted to the controller 100. The magnetic strip 148 may store a large variety of data, which may include for example, the identification of a player, the player's personal information, the player's gaming habits including the player's frequency of play, the player's betting limits and trends, as well as any other gaming data to be stored and tracked. The data storage device may also comprise more sophisticated apparatuses such as optically readable memories, semiconductor memories such as RAMs, etc. The data storage device 148 and corresponding data reading apparatus 128 (see FIG. 4) may also be configured so that the data reading apparatus 128, or a separate component, is capable of writing data to the data storage device 148 on the player tracking card 59*a*.

Player Tracking Card with Embedded Optic Fibers

Figure 6:
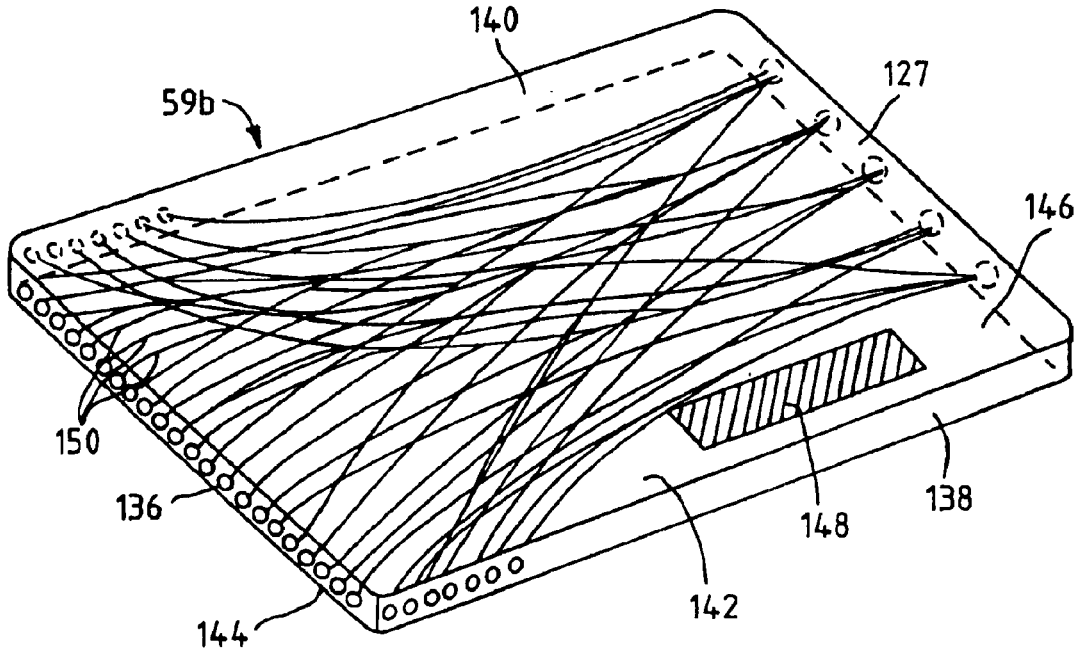
FIG. 6 is a schematic representation of an embodiment of a player tracking card having embedded optic fibers.

FIG. 6. is a perspective view of another embodiment of a player tracking card 59*b*, wherein the light transmissive body portion 146 may comprise a plurality of optic fibers 150 embedded within the player tracking card 59*b*. The optic fibers 150 extend between the first card surface 127 and the second, third, and fourth card surfaces 136, 138, and 140. When the player tracking card 59*b* is disposed in the card reader 58 and positioned in the card illumination position, light from the light generating sources 122 (see FIG. 4) is transmitted to the first card surface 127, through the optic fibers 150, and may be visible on the second card surface 136 and portions of the other card surfaces, such as the third and fourth card surfaces 138 and 140. Thus, by controlling the color, intensity, and pattern of illumination of the light generating sources 122, the gaming apparatus 20 is capable of displaying player status, machine status, etc. to the player and other interested persons. Additionally, the illumination of the card surface or surfaces may be utilized to attract players to a specific gaming apparatus.

The player tracking card 59*b* may also comprise a data storage device, such as the magnetic strip 148. The magnetic strip 148 may store a variety of gaming data, which may include the identity of the user. Other types of data storage devices known to those skilled in the art may also be used.

Player Tracking Card with Inductive Coupling

Figure 7:
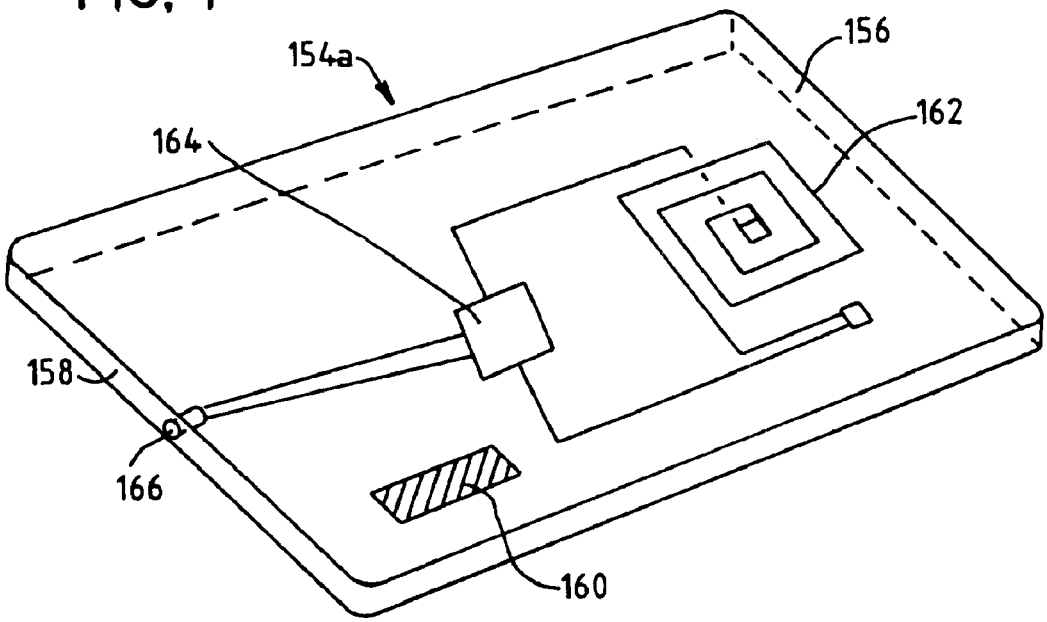
FIG. 7 is a schematic representation of an embodiment of a player tracking card having an energy transfer apparatus for inductive coupling.

FIG. 7 is an embodiment of a player tracking card 154*a* for disposal in a card reader 58 of a gaming apparatus 20. The player tracking card 154*a* may comprise a first card surface 156 and a second card surface 158, wherein the first card surface 156 is spaced apart from and generally parallel to the second card surface 158. The player tracking card 154*a* may also include a data storage device, such as a magnetic strip 160 that stores data representing the identification of a player as well as a variety of other gaming data. An energy transfer apparatus may also be present on the player tracking card 154*a*.

In this embodiment, the energy transfer apparatus may comprise a conductive coil 162 that may be embedded within the player tracking card 154*a* or disposed on player tracking card 154*a*. The conductive coil 162 may operate as an antenna to inductively receive energy from one or more energy transfer apparatuses on the gaming apparatus, such as the energy transfer apparatus 130 from FIG. 4, when the player tracking card 154*a* is positioned in the card illumination position. The conductive coil 162 and the corresponding energy transfer apparatus 130 may also operate to transfer energy from the player tracking card 154*a* to the gaming apparatus 20. The energy transferred to, and received by, the player tracking card 154*a* may comprise both power and data. The conductive coil 162 in FIG. 7 may comprise a spiral pattern residing substantially in the same plane. As is well known to those skilled in the art, additional loops may be added to increase the magnetic flux created. Additionally, a plethora of antenna designs may be utilized to improve the efficiency of energy transfer and coupling performance between the conductive coil 162 and the energy transfer apparatus 130. Additionally, antennas may be designed to substantially cancel out the magnetic fluxes and thereby reduce the total amount of emitted radiation.

The conductive coil 162 may be connected to additional electronics 164 or directly to a light generating source 166 so that the light generating source 166 receives electrical energy to provide illumination. Light generated by the light generating source 166 may be visible on the second edge 158 of the player tracking card 154*a*. The light may also be visible on portions of the other card surfaces that are exposed and visible, when the first card surface 156 is disposed in the card reader 58 and the player tracking card 154*a* is positioned in the card illumination position. The light generating source 166 may be located on the player tracking card 154*a* adjacent the second card surface 158 so that light is directly viewable to a player through the second card surface 158. Or, the light generating source 166 may be located further away from the perimeter of the player tracking card 154*a* and a light transmissive medium, such as an optic fiber, may be utilized to transmit light from the light generating source 166 to the second card surface 158. Additionally, multiple optic fibers or other light transmissive mediums may have one of their ends positioned near the light generating source 166 and the other ends located in multiple locations on the second card surface 158 so that it may appear to the viewer as multiple light sources. It should also be noted that the player tracking card 154*a* may comprise a plurality of light generating sources similar to the light generating source 166. The light generating source 166 may comprise, for example, an LED, an OLED, an incandescent, a fluorescent, etc. The intensity and duration of illumination of the light generating source 166 may be controlled by the controller 100 through the inductive coupling of the conductive coil 162 and the energy transfer apparatus 130.

The additional electronics 164 on the player tracking card 154*a* may also comprise a data storage device, such as a RAM. While not required, the additional electronics 164 may also comprise an on-card microprocessor to work in conjunction with the RAM and assist in controlling the light generating source 166 and interfacing with the controller 100 of the gaming apparatus 20.

Player Tracking Card with Capacitative Coupling

Figure 8:
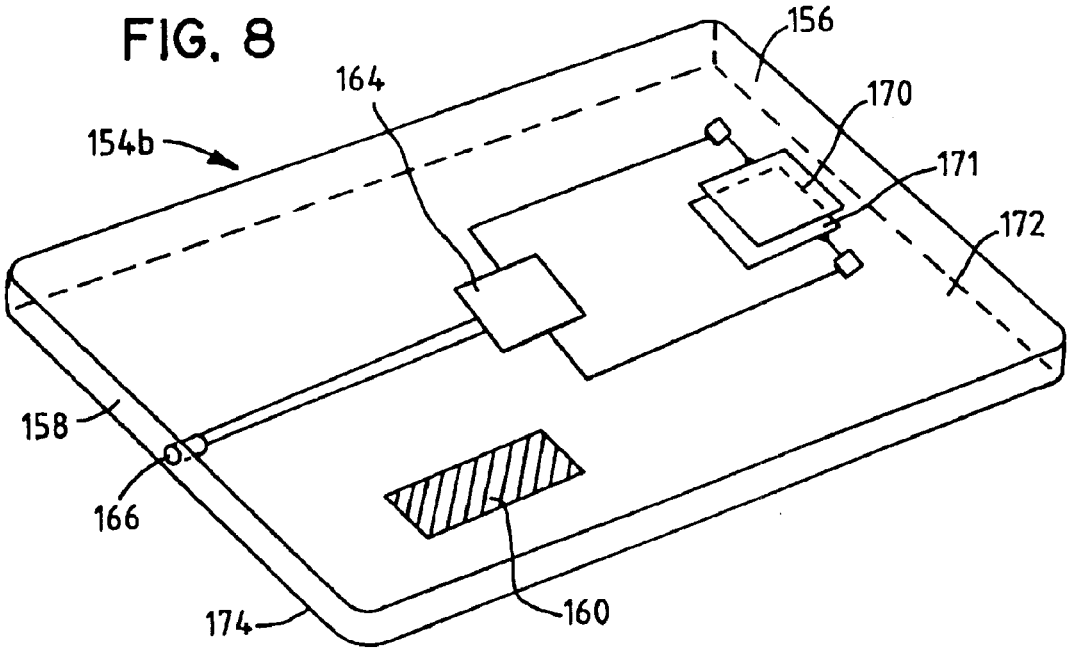
FIG. 8 is a schematic representation of an embodiment of a player tracking card having an energy transfer apparatus for capacitative coupling.

FIG. 8 is another embodiment of the player tracking card 154*a* from FIG. 7 wherein the energy transfer apparatus is replaced with a first metallic plate 170 and a second metallic plate 171 in the player tracking card 154*b*. The first and second metallic plates 170 and 171 may be embedded within the player tracking card 154*b*, disposed on a single surface, such as the third card surface 172 of the player tracking card 154*b*, or disposed on opposite surfaces that are space apart from and generally parallel to each other, such as the third card surface 172 and a fourth card surface 174. As in FIG. 7, the player tracking card 154*b* may comprise a first card surface 156 and a second card surface 158, wherein the first card surface 156 is spaced apart from and generally parallel to the second card surface 158. The player tracking card 154*b* may also include a data storage device, such as a magnetic strip 160 or an optically readable material such as ink, that stores data representing the identification of a player as well as a variety of other gaming data.

As discussed above, the energy transfer apparatus in this embodiment may comprise the first and second metallic plates 170 and 171. The metallic plates 170 and 171, operating separately as one plate of two capacitors (one of the plates may be used as a return path for AC signals), may receive energy from one or more energy transfer apparatuses on the gaming apparatus 20, such as the energy transfer apparatus 130 from FIG. 4, when the player tracking card 154*b* is positioned in the card illumination position. The metallic plates 170 and 171, and the corresponding energy transfer apparatus(es) 130 may also operate to transfer energy from the player tracking card 154*b* to the gaming apparatus 20. The energy transferred to, and received by, the player tracking card 154*b* may comprise both power and data. The surface area of the metallic plates 170 and 171 may be determined by the product of the length and width of the metallic plates 170 and 171, and may comprise a variety of different dimensions. As is well known to those skilled in the art, the area of the metallic plates 170 and 171 may be varied to improve the efficiency of energy transfer and coupling performance between the metallic plates 170 and 171 and the energy transfer apparatus 130.

The metallic plates 170 and 171 may be connected to additional electronics 164 or directly to a light generating source 166 so that the light generating source 166 receives power for illumination. As in FIG. 7, light generated by the light generating source 166 may be visible on the second edge 158 of the player tracking card 154*b*. The light may also be visible on portions of the other card surfaces that are exposed and visible, when the first card surface 156 is disposed in the card reader 58 and the player tracking card 154*b* is positioned in the card illumination position. The light generating source 166 may be located on the player tracking card 154*b* adjacent the second card surface 158 so that light is directly viewable to a player through the second card surface 158. The light generating source 166 may alternatively be located further away from the perimeter of the player tracking card 154*b* and a light transmissive medium, such as an optic fiber, may be used to transmit light from the light generating source 166 to the second card surface 158. Additionally, multiple optic fibers or other light transmissive mediums may have one of their ends positioned near the light generating source 166 and the other ends located in multiple locations on the second card surface 158 so that it may appear to the viewer as multiple light sources. It should also be noted that the player tracking card 154*b* may comprise a plurality of light generating sources similar to the light generating source 166. The light generating source 166 may comprise, for example, an LED, an OLED, an incandescent, a fluorescent, etc. The intensity and duration of illumination of the light generating source 166 may be controlled by the controller 100 through the capacitative coupling of the metallic plate 170 and the energy transfer apparatus 130.

The additional electronics 164 on the player tracking card 154*b* may also comprise a data storage device, such as a RAM. The additional electronics 164 may also comprise an on-card microprocessor to work in conjunction with the RAM and assist in controlling the light generating source 166 and interfacing with the controller 100 of the gaming apparatus 20.

Player Tracking Card with Conductive Coupling

Figure 9:
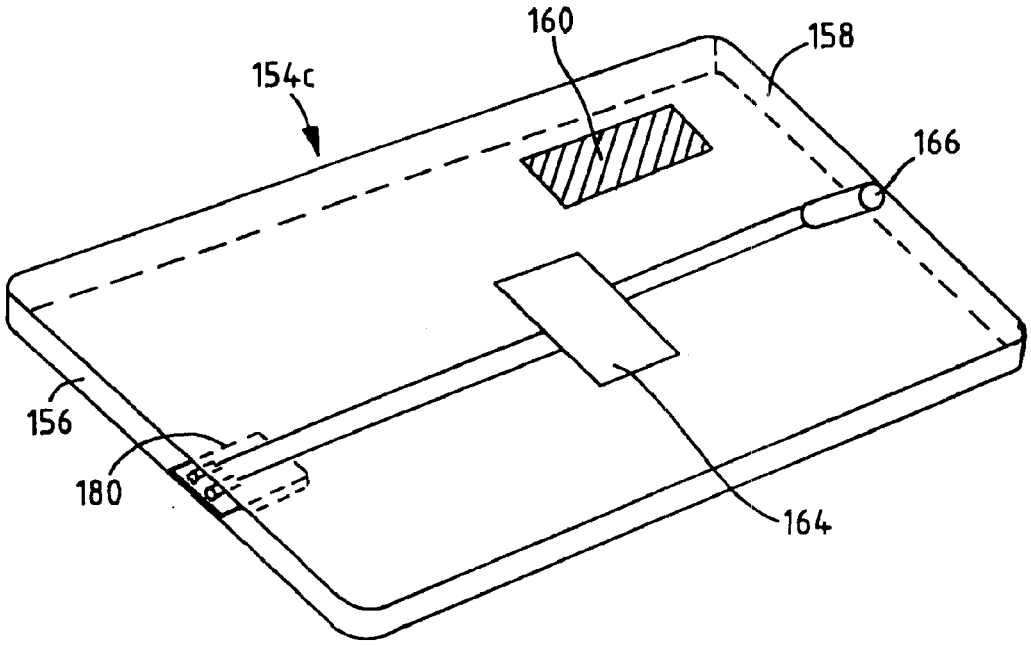
FIG. 9 is a schematic representation of an embodiment of a player tracking card having an energy transfer apparatus for conductive transfers of energy.

FIG. 9 is another embodiment of the player tracking card 154*a* from FIG. 7 wherein the energy transfer apparatus is replaced with a conductive port 180 on a player tracking card 154*c*. The conductive port 180 may be embedded within the player tracking card 154*c*. As in FIG. 7, the player tracking card 154*c* may comprise a first card surface 156 and a second card surface 158, wherein the first card surface 156 is spaced apart from and generally parallel to the second card surface 158. The player tracking card 154*c* may also include a data storage device, such as a magnetic strip 160 that stores data representing the identification of a player as well as a variety of other gaming data.

As discussed above, the energy transfer apparatus in this embodiment comprises the conductive port 180. The conductive port 180 operates in conjunction with a second conductive port that is associated with the gaming apparatus 20 and may be located on the back structure 120 of the chassis 114. The conductive port 180 may interconnect with the corresponding conductive port associated with the gaming apparatus 20 when the player tracking card 154*c* is disposed in the card reader 58 and positioned in the card illumination position. The conductive ports may comprise one or more separate connections to transfer power and/or data between the gaming apparatus 20 and the player tracking card 154*c*. The conductive ports may utilize modular plugs to interconnect wherein one of the conductive ports, such as conductive port 180, includes at least one male connector (i.e. a metallic prong or pin) and the other conductive port includes a corresponding number of female connectors (i.e. a metallic receptacle) to mate with the male connector and complete a conductive path for energy transmission. As in the embodiment of FIG. 9, the metallic pins of the conductive port 180 may be recessed within the player tracking card 154*c* so that their ends do not extend beyond the first card surface 156. By recessing the pins, they may be protected from being bent or otherwise damaged.

The conductive port 180 may receive energy from the corresponding energy transfer apparatus (i.e. the conductive port associated with the gaming apparatus) when the player tracking card 154*c* is positioned in the card illumination position. The conductive port 180 and the corresponding conductive port on the gaming apparatus 20 may also operate to transfer energy from the player tracking card 154*c* to the gaming apparatus 20. The energy transferred to, and received by, the player tracking card 154*c* may comprise both power and data.

The conductive port 180 may be connected to additional electronics 164 or directly to a light generating source 166 so that the light generating source 166 receives power for illumination. As in FIG. 7, light generated by the light generating source 166 may be visible on the second edge 158 of the player tracking card 154*c*. The light may also be visible on portions of the other card surfaces that are exposed and visible, when the first card surface 156 is disposed in the card reader 58 and the player tracking card 154*c* is positioned in the card illumination position. The light generating source 166 may be located on the player tracking card 154*c* adjacent the second card surface 158 so that light is directly viewable to a player through the second card surface 158. The light generating source 166 may alternatively be located further away from the perimeter of the player tracking card 154*c* and a light transmissive medium, such as an optic fiber, may be used to transmit light from the light generating source 166 to the second card surface 158. Additionally, multiple optic fibers or other light transmissive mediums may have one of their ends positioned near the light generating source 166 and the other ends located in multiple locations on the second card surface 158 so that it may appear to the viewer as multiple light sources. It should also be noted that the player tracking card 154*c* may comprise a plurality of light generating sources similar to the light generating source 166. The light generating source 166 may comprise, for example, an LED, an OLED, an incandescent, a fluorescent, etc. The intensity and duration of illumination of the light generating source 166 is controlled by the controller 100 through the conductive port 180 and the corresponding conductive port on the gaming apparatus 20.

The additional electronics 164 on the player tracking card 154*c* may also comprise a data storage device, such as a semiconductor memory, a magnetically readable memory, and/or an optically readable memory. The additional electronics 164 may also comprise an on-card microprocessor to work in conjunction with the data storage device and assist in controlling the light generating source 166 and interfacing with the controller 100 of the gaming apparatus 20.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C+, C++ or the like or any low-level, assembly or machine language. By storing the computer program portions therein, various portions of the memories 102, 106 are physically and/or structurally configured in accordance with computer program instructions.

Figure 10:
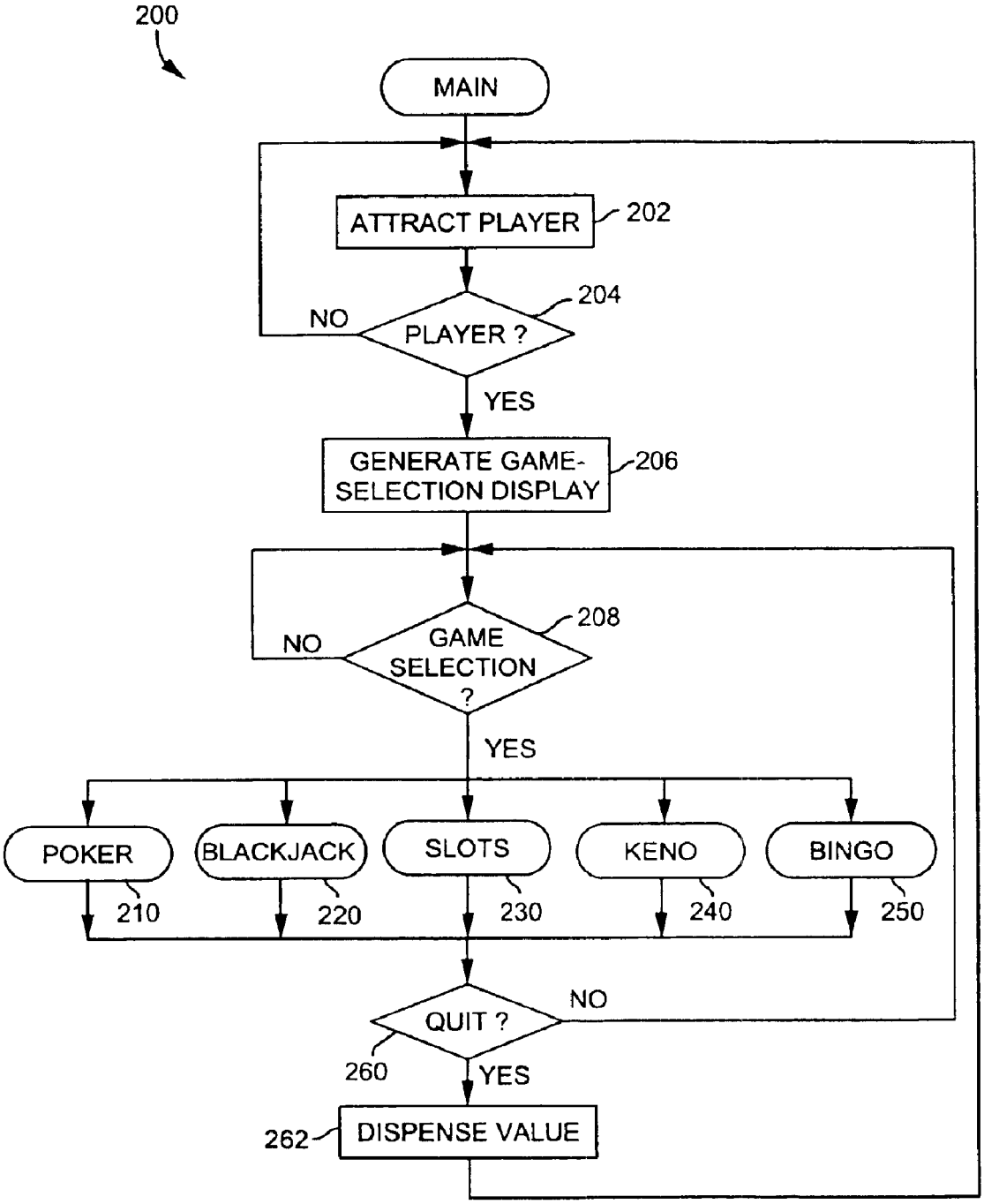
FIG. 10 is a flowchart of an embodiment of a main routine that may be performed during operation of one or more of the gaming units.

FIG. 10 is a flowchart of a main operating routine 200 that may be stored in the memory of the controller 100. Referring to FIG. 10, the main routine 200 may begin operation at block 202 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, etc.

During performance of the attraction sequence, if a potential player makes any input to the gaming unit 20 as determined at block 204, the attraction sequence may be terminated and a game-selection display may be generated on the display unit 70 at block 206 to allow the player to select a game available on the gaming unit 20. The gaming unit 20 may detect an input at block 204 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; etc.

The game-selection display generated at block 206 may include, for example, a list of video games that may be played on the gaming unit 20 and/or a visual message to prompt the player to deposit value into the gaming unit 20. While the game-selection display is generated, the gaming unit 20 may wait for the player to make a game selection.

Upon selection of one of the games by the player as determined at block 208, the controller 100 may cause one of a number of game routines to be performed to allow the selected game to be played. For example, the game routines could include a video poker routine 210, a video blackjack routine 220, a slots routine 230, a video keno routine 240, and a video bingo routine 250. At block 208, if no game selection is made within a given period of time, the operation may branch back to block 202.

After one of the routines 210, 220, 230, 240, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player at block 262 based on the outcome of the game(s) played by the player. The operation may then return to block 202. If the player did not wish to quit as determined at block 260, the routine may return to block 208 where the game-selection display may again be generated to allow the player to select another game.

It should be noted that although five gaming routines are shown in FIG. 10, a different number of routines could be included to allow play of a different number of games. The gaming unit 20 may also be programmed to allow play of different games.

Figure 11:
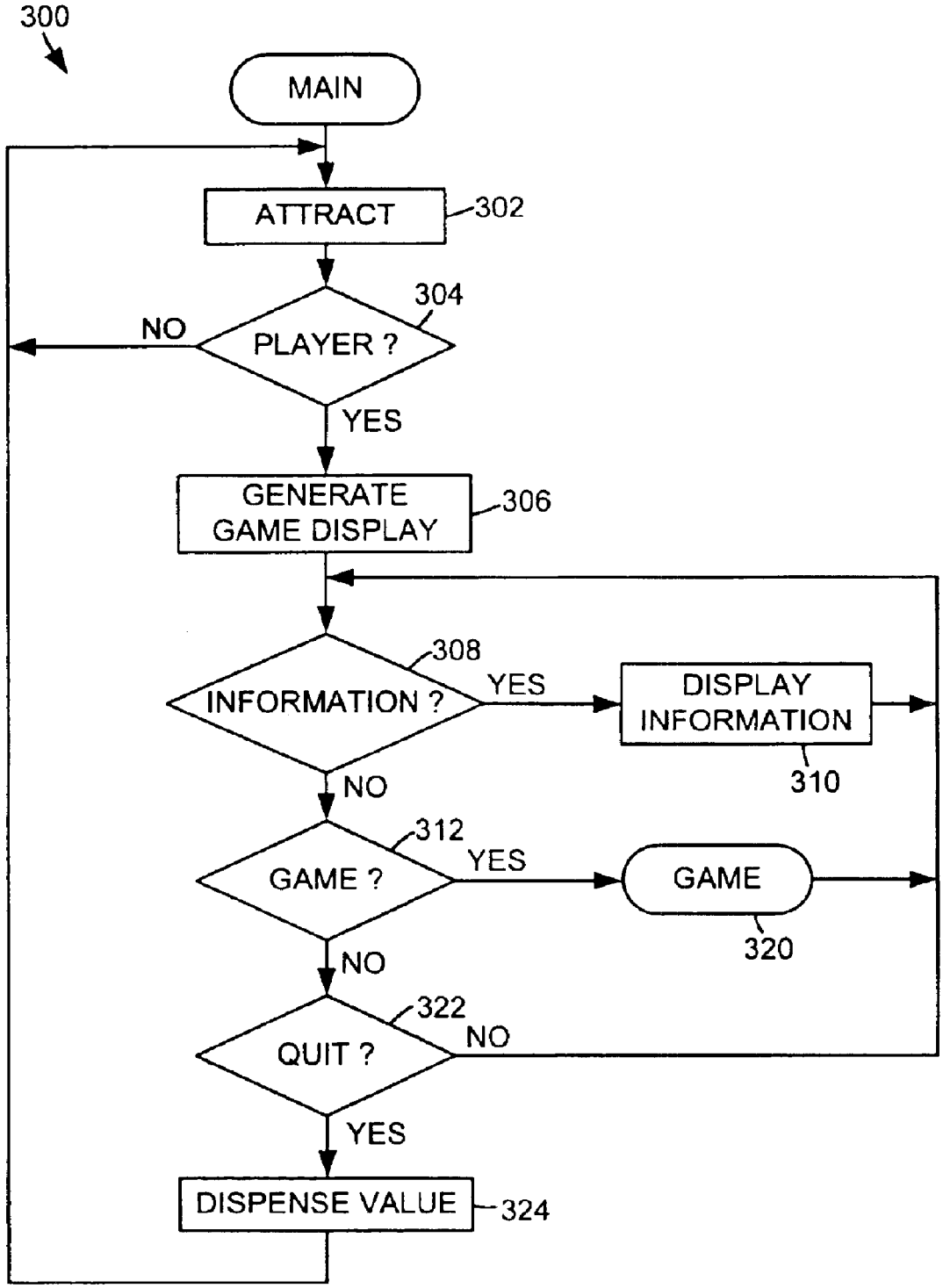
FIG. 11 is a flowchart of an alternative embodiment of a main routine that may be performed during operation of one or more of the gaming units.

FIG. 11 is a flowchart of an alternative main operating routine 300 that may be stored in the memory of the controller 100. The main routine 300 may be utilized for gaming units 20 that are designed to allow play of only a single game or single type of game. Referring to FIG. 11, the main routine 300 may begin operation at block 302 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62.

During performance of the attraction sequence, if a potential player makes any input to the gaming unit 20 as determined at block 304, the attraction sequence may be terminated and a game display may be generated on the display unit 70 at block 306. The game display generated at block 306 may include, for example, an image of the casino game that may be played on the gaming unit 20 and/or a visual message to prompt the player to deposit value into the gaming unit 20. At block 308, the gaming unit 20 may determine if the player requested information concerning the game, in which case the requested information may be displayed at block 310. Block 312 may be used to determine if the player requested initiation of a game, in which case a game routine 320 may be performed. The game routine 320 could be any one of the game routines disclosed herein, such as one of the five game routines 210, 220, 230, 240, 250, or another game routine.

After the routine 320 has been performed to allow the player to play the game, block 322 may be utilized to determine whether the player wishes to terminate play on the gaming unit 20. If the player wishes to stop playing the gaming unit 20, which wish may be expressed, for example, by selecting a "Cash Out" button, the controller 100 may dispense value to the player at block 324 based on the outcome of the game(s) played by the player. The operation may then return to block 302. If the player did not wish to quit as determined at block 322, the operation may return to block 308.

Video Poker

Figure 12:
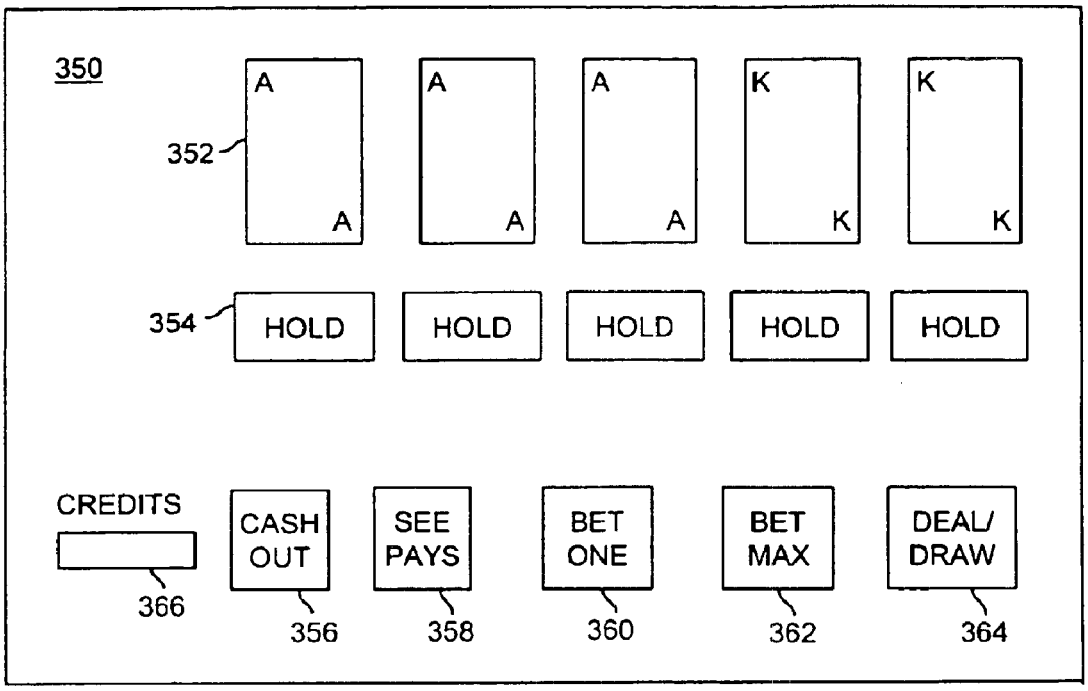
FIG. 12 is an illustration of an embodiment of a visual display that may be displayed during performance of the video poker routine of FIG. 14.

FIG. 12 is an exemplary display 350 that may be shown on the display unit 70 during performance of the video poker routine 210 shown schematically in FIG. 10. Referring to FIG. 12, the display 350 may include video images 352 of a plurality of playing cards representing the player's hand, such as five cards. To allow the player to control the play of the video poker game, a plurality of player-selectable buttons may be displayed. The buttons may include a "Hold" button 354 disposed directly below each of the playing card images 352, a "Cash Out" button 356, a "See Pays" button 358, a "Bet One Credit" button 360, a "Bet Max Credits" button 362, and a "Deal/Draw" button 364. The display 350 may also include an area 366 in which the number of remaining credits or value is displayed. If the display unit 70 is provided with a touch-sensitive screen, the buttons 354, 356, 358, 360, 362, 364 may form part of the video display 350. Alternatively, one or more of those buttons may be provided as part of a control panel that is provided separately from the display unit 70.

Figure 14:
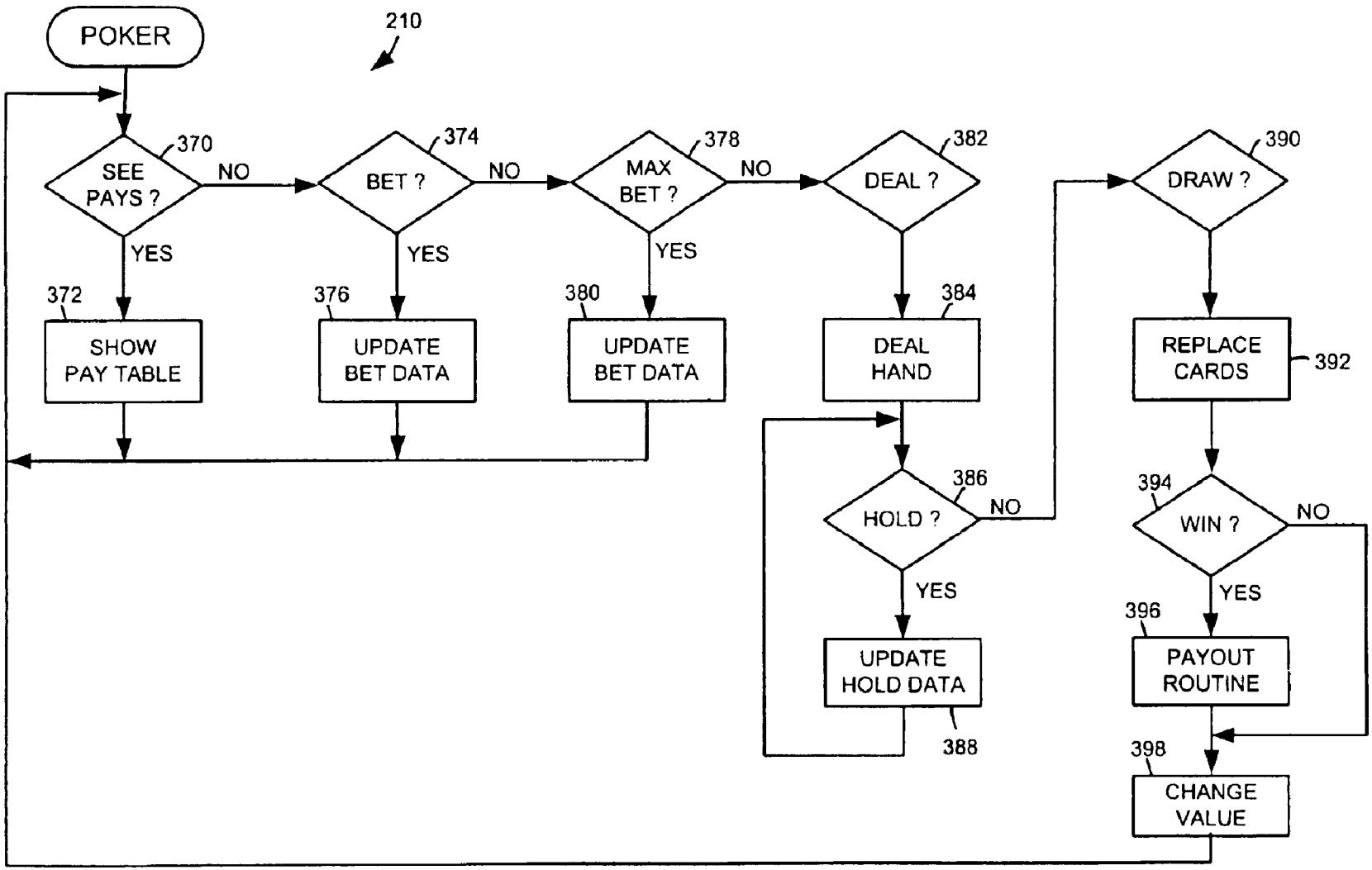
FIG. 14 is a flowchart of an embodiment of a video poker routine that may be performed by one or more of the gaming units.

FIG. 14 is a flowchart of the video poker routine 210 shown schematically in FIG. 10. Referring to FIG. 14, at block 370, the routine may determine whether the player has requested payout information, such as by activating the "See Pays" button 358, in which case at block 372 the routine may cause one or more pay tables to be displayed on the display unit 70. At block 374, the routine may determine whether the player has made a bet, such as by pressing the "Bet One Credit" button 360, in which case at block 376 bet data corresponding to the bet made by the player may be stored in the memory of the controller 100. At block 378, the routine may determine whether the player has pressed the "Bet Max Credits" button 362, in which case at block 380 bet data corresponding to the maximum allowable bet may be stored in the memory of the controller 100.

At block 382, the routine may determine if the player desires a new hand to be dealt, which may be determined by detecting if the "Deal/Draw" button 364 was activated after a wager was made. In that case, at block 384 a video poker hand may be "dealt" by causing the display unit 70 to generate the playing card images 352. After the hand is dealt, at block 386 the routine may determine if any of the "Hold" buttons 354 have been activated by the player, in which case data regarding which of the playing card images 352 are to be "held" may be stored in the controller 100 at block 388. If the "Deal/Draw" button 364 is activated again as determined at block 390, each of the playing card images 352 that was not "held" may be caused to disappear from the video display 350 and to be replaced by a new, randomly selected, playing card image 352 at block 392.

At block 394, the routine may determine whether the poker hand represented by the playing card images 352 currently displayed is a winner. That determination may be made by comparing data representing the currently displayed poker hand with data representing all possible winning hands, which may be stored in the memory of the controller 100. If there is a winning hand, a payout value corresponding to the winning hand may be determined at block 396. At block 398, the player's cumulative value or number of credits may be updated by subtracting the bet made by the player and adding, if the hand was a winner, the payout value determined at block 396. The cumulative value or number of credits may also be displayed in the display area 366 (FIG. 12).

Although the video poker routine 210 is described above in connection with a single poker hand of five cards, the routine 210 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 13:
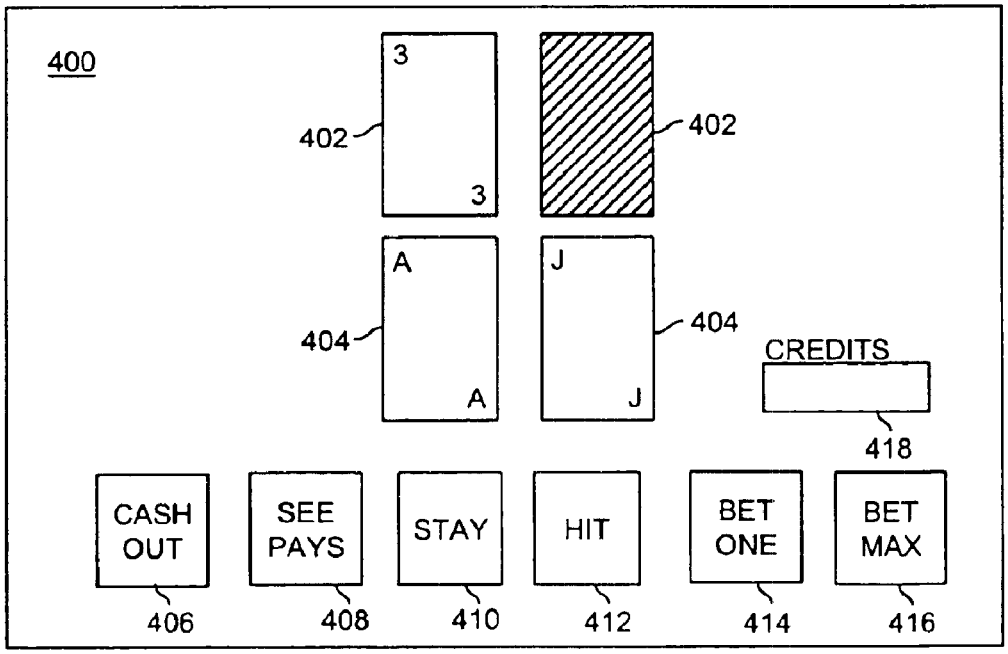
FIG. 13 is an illustration of an embodiment of a visual display that may be displayed during performance of the video blackjack routine of FIG. 15.

FIG. 13 is an exemplary display 400 that may be shown on the display unit 70 during performance of the video blackjack routine 220 shown schematically in FIG. 10. Referring to FIG. 13, the display 400 may include video images 402 of a pair of playing cards representing a dealer's hand, with one of the cards shown face up and the other card being shown face down, and video images 404 of a pair of playing cards representing a player's hand, with both the cards shown face up. The "dealer" may be the gaming unit 20.

To allow the player to control the play of the video blackjack game, a plurality of player-selectable buttons may be displayed. The buttons may include a "Cash Out" button 406, a "See Pays" button 408, a "Stay" button 410, a "Hit" button 412, a "Bet One Credit" button 414, and a "Bet Max Credits" button 416. The display 400 may also include an area 418 in which the number of remaining credits or value is displayed. If the display unit 70 is provided with a touch-sensitive screen, the buttons 406, 408, 410, 412, 414, 416 may form part of the video display 400. Alternatively, one or more of those buttons may be provided as part of a control panel that is provided separately from the display unit 70.

Figure 15:
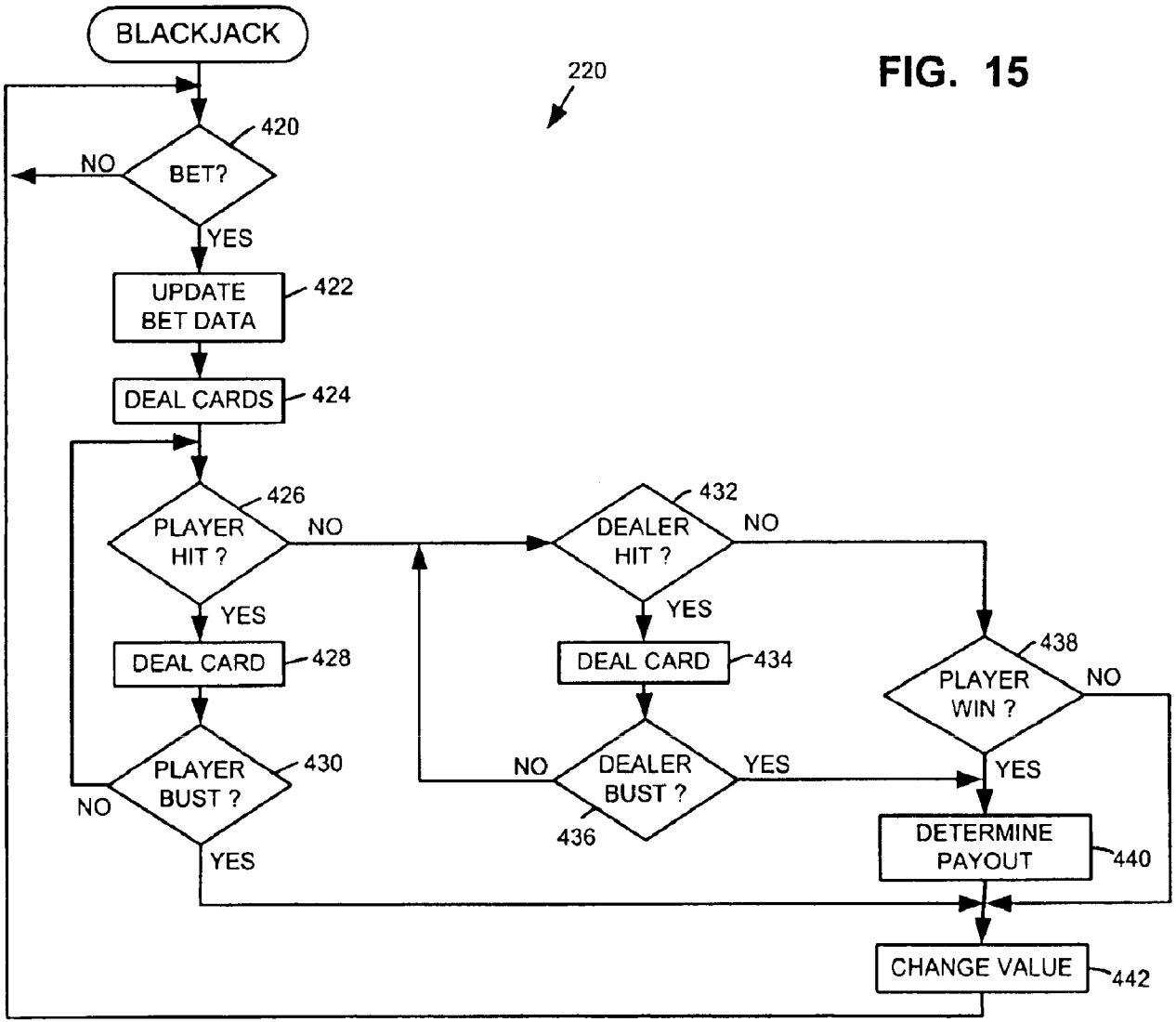
FIG. 15 is a flowchart of an embodiment of a video blackjack routine that may be performed by one or more of the gaming units.

FIG. 15 is a flowchart of the video blackjack routine 220 shown schematically in FIG. 10. Referring to FIG. 15, the video blackjack routine 220 may begin at block 420 where it may determine whether a bet has been made by the player. That may be determined, for example, by detecting the activation of either the "Bet One Credit" button 414 or the "Bet Max Credits" button 416. At block 422, bet data corresponding to the bet made at block 420 may be stored in the memory of the controller 100. At block 424, a dealer's hand and a player's hand may be "dealt" by making the playing card images 402, 404 appear on the display unit 70.

At block 426, the player may be allowed to be "hit," in which case at block 428 another card will be dealt to the player's hand by making another playing card image 404 appear in the display 400. If the player is hit, block 430 may determine if the player has "bust," or exceeded 21. If the player has not bust, blocks 426 and 428 may be performed again to allow the player to be hit again.

If the player decides not to hit, at block 432 the routine may determine whether the dealer should be hit. Whether the dealer hits may be determined in accordance with predetermined rules, such as the dealer always hit if the dealer's hand totals 15 or less. If the dealer hits, at block 434 the dealer's hand may be dealt another card by making another playing card image 402 appear in the display 400. At block 436 the routine may determine whether the dealer has bust. If the dealer has not bust, blocks 432, 434 may be performed again to allow the dealer to be hit again.

If the dealer does not hit, at block 436 the outcome of the blackjack game and a corresponding payout may be determined based on, for example, whether the player or the dealer has the higher hand that does not exceed 21. If the player has a winning hand, a payout value corresponding to the winning hand may be determined at block 440. At block 442, the player's cumulative value or number of credits may be updated by subtracting the bet made by the player and adding, if the player won, the payout value determined at block 396. The cumulative value or number of credits may also be displayed in the display area 418 (FIG. 13).

Slots

FIG. 16 is an exemplary display 450 that may be shown on the display unit 70 during performance of the slots routine 230 shown schematically in FIG. 10. Referring to FIG. 16, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized.

To allow the player to control the play of the slots game, a plurality of player-selectable buttons may be displayed. The buttons may include a "Cash Out" button 456, a "See Pays" button 458, a plurality of payline-selection buttons 460 each of which allows the player to select a different number of paylines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 18:
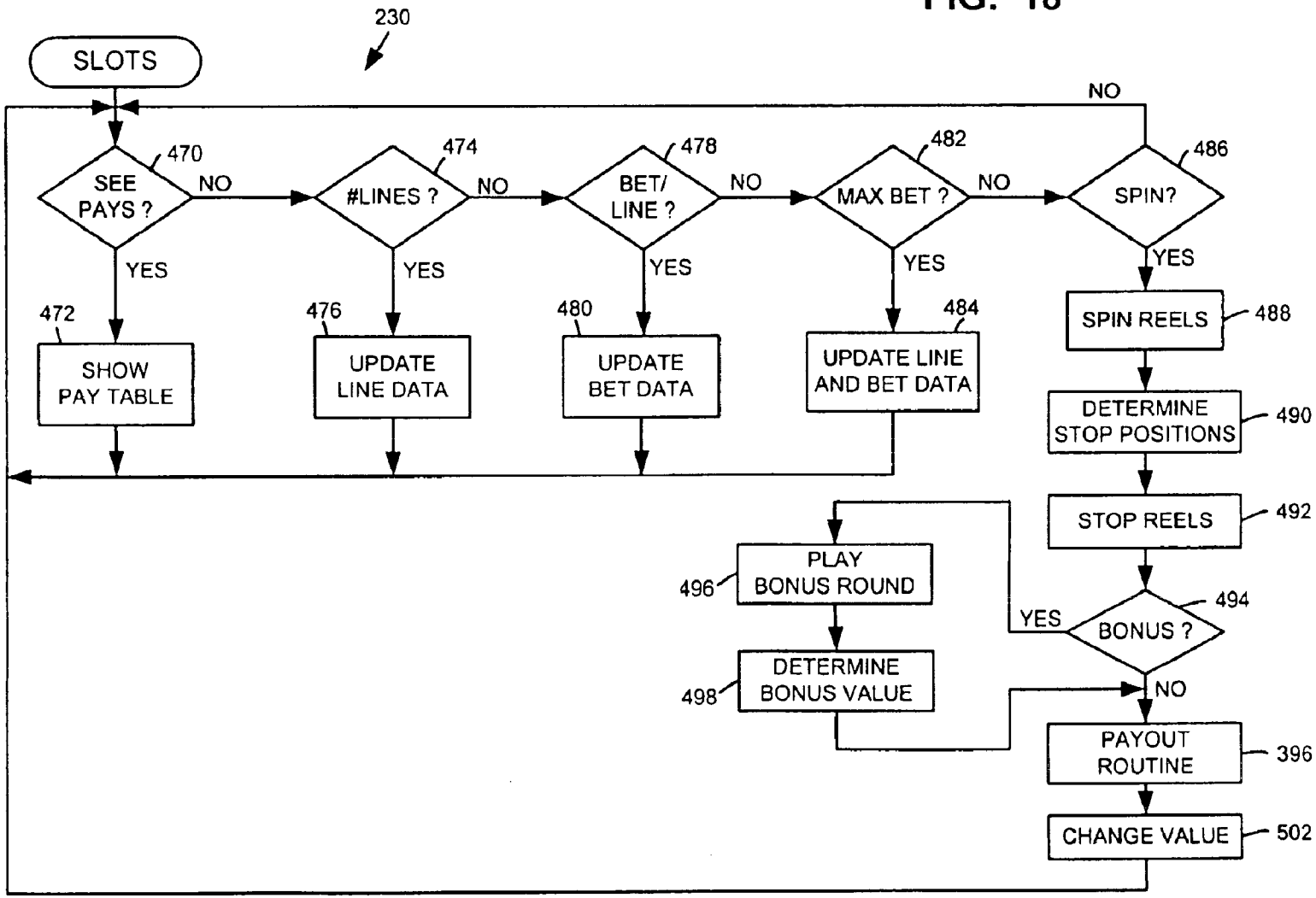
FIG. 18 is a flowchart of an embodiment of a slots routine that may be performed by one or more of the gaming units.

FIG. 18 is a flowchart of the slots routine 230 shown schematically in FIG. 16. Referring to FIG. 18, at block 470, the routine may determine whether the player has requested payout information, such as by activating the "See Pays" button 458, in which case at block 472 the routine may cause one or more pay tables to be displayed on the display unit 70. At block 474, the routine may determine whether the player has pressed one of the payline-selection buttons 460, in which case at block 476 data corresponding to the number of paylines selected by the player may be stored in the memory of the controller 100. At block 478, the routine may determine whether the player has pressed one of the bet-selection buttons 462, in which case at block 480 data corresponding to the amount bet per payline may be stored in the memory of the controller 100. At block 482, the routine may determine whether the player has pressed the "Max Bet" button 466, in which case at block 484 bet data (which may include both payline data and bet-per-payline data) corresponding to the maximum allowable bet may be stored in the memory of the controller 100.

If the "Spin" button 464 has been activated by the player as determined at block 486, at block 488 the routine may cause the slot machine reel images 452 to begin "spining" so as to simulate the appearance of a plurality of spinning mechanical slot machine reels. At block 490, the routine may determine the positions at which the slot machine reel images will stop, or the particular symbol images 454 that will be displayed when the reel images 452 stop spinning. At block 492, the routine may stop the reel images 452 from spinning by displaying stationary reel images 452 and images of three symbols 454 for each stopped reel image 452. The virtual reels may be stopped from left to right, from the perspective of the player, or in any other manner or sequence.

The routine may provide for the possibility of a bonus game or round if certain conditions are met, such as the display in the stopped reel images 452 of a particular symbol 454. If there is such a bonus condition as determined at block 494, the routine may proceed to block 496 where a bonus round may be played. The bonus round may be a different game than slots, and many other types of bonus games could be provided. If the player wins the bonus round, or receives additional credits or points in the bonus round, a bonus value may be determined at block 498. A payout value corresponding to outcome of the slots game and/or the bonus round may be determined at block 500. At block 502, the player's cumulative value or number of credits may be updated by subtracting the bet made by the player and adding, if the slot game and/or bonus round was a winner, the payout value determined at block 500.

Although the above routine has been described as a virtual slot machine routine in which slot machine reels are represented as images on the display unit 70, actual slot machine reels that are capable of being spun may be utilized instead.

Video Keno

FIG. 17 is an exemplary display 520 that may be shown on the display unit 70 during performance of the video keno routine 240 shown schematically in FIG. 10. Referring to FIG. 17, the display 520 may include a video image 522 of a plurality of numbers that were selected by the player prior to the start of a keno game and a video image 524 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 526, a "See Pays" button 528, a "Bet One Credit" button 530, a "Bet Max Credits" button 532, a "Select Ticket" button 534, a "Select Number" button 536, and a "Play" button 538. The display 520 may also include an area 540 in which the number of remaining credits or value is displayed. If the display unit 70 is provided with a touch-sensitive screen, the buttons may form part of the video display 520. Alternatively, one or more of those buttons may be provided as part of a control panel that is provided separately from the display unit 70.

Figure 19:
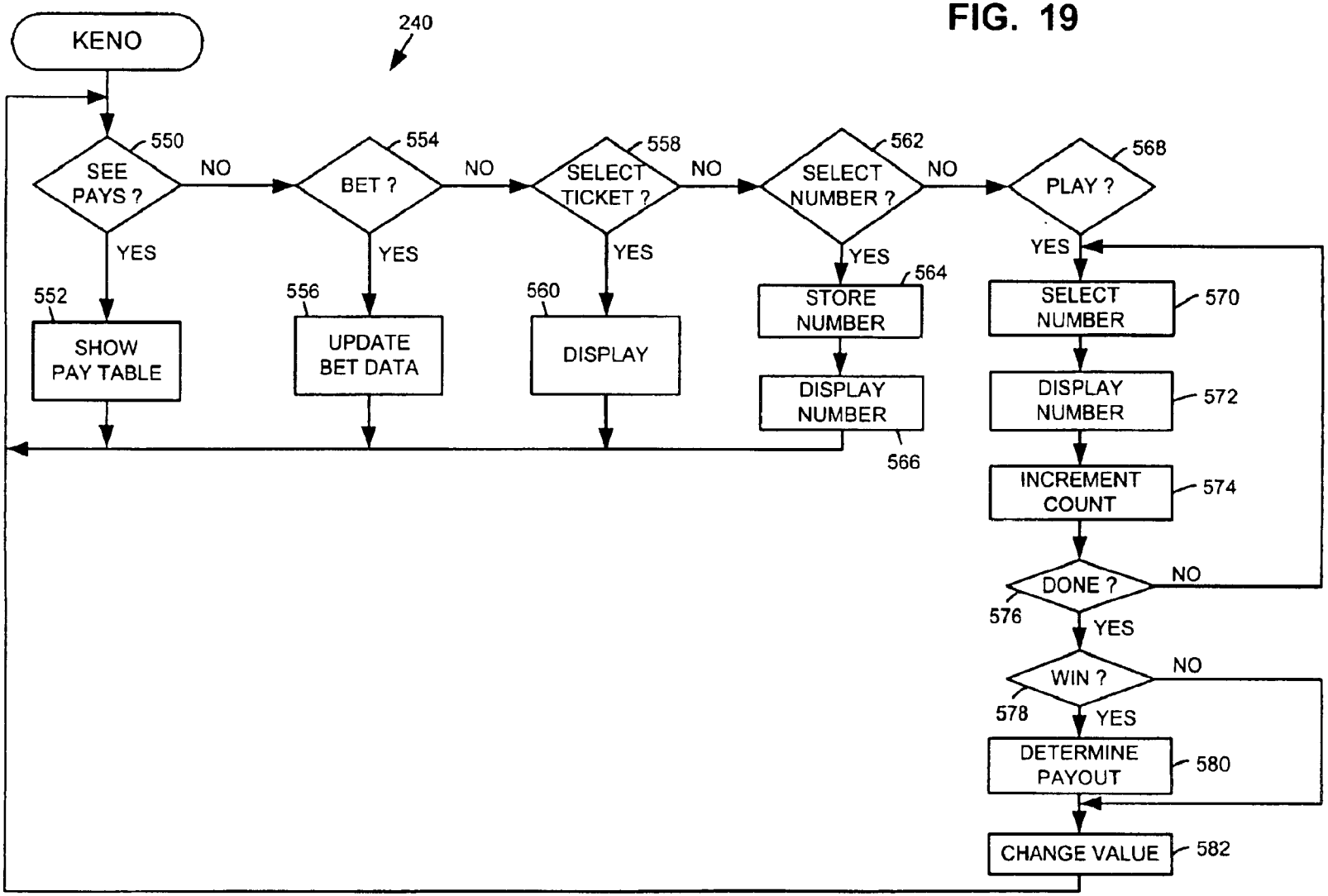
FIG. 19 is a flowchart of an embodiment of a video keno routine that may be performed by one or more of the gaming units.

FIG. 19 is a flowchart of the video keno routine 240 shown schematically in FIG. 10. The keno routine 240 may be utilized in connection with a single gaming unit 20 where a single player is playing a keno game, or the keno routine 240 may be utilized in connection with multiple gaming units 20 where multiple players are playing a single keno game. In the latter case, one or more of the acts described below may be performed either by the controller 100 in each gaming unit or by one of the network computer 22, 32 to which multiple gaming units 20 are operatively connected.

Referring to FIG. 19, at block 550, the routine may determine whether the player has requested payout information, such as by activating the "See Pays" button 528, in which case at block 552 the routine may cause one or more pay tables to be displayed on the display unit 70. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the controller 100. After the player has made a wager, at block 558 the player may select a keno ticket, and at block 560 the ticket may be displayed on the display 520. At block 562, the player may select one or more game numbers, which may be within a range set by the casino. After being selected, the player's game numbers may be stored in the memory of the controller 100 at block 564 and may be included in the image 522 on the display 520 at block 566. After a certain amount of time, the keno game may be closed to additional players (where a number of players are playing a single keno game using multiple gambling units 20).

If play of the keno game is to begin as determined at block 568, at block 570 a game number within a range set by the casino or other facility may be randomly selected either by the controller 100 or a central computer operatively connected to the controller, such as one of the network computers 22, 32. At block 572, the randomly selected game number may be displayed on the display unit 70 and the display units 70 of other gaming units 20 (if any) which are involved in the same keno game. At block 574, the controller 100 (or the central computer noted above) may increment a count which keeps track of how many game numbers have been selected at block 570.

At block 576, the controller 100 (or one of the network computers 22, 32) may determine whether a maximum number of game numbers within the range have been randomly selected. If not, another game number may be randomly selected at block 570. If the maximum number of game numbers has been selected, at block 578 the controller 100 (or a central computer) may determine whether there are a sufficient number of matches between the game numbers selected by the player and the game numbers selected at block 570 to cause the player to win. The number of matches may depend on how many numbers the player selected and the particular keno rules being used.

If there are a sufficient number of matches, a payout may be determined at block 580 to compensate the player for winning the game. The payout may depend on the number of matches between the game numbers selected by the player and the game numbers randomly selected at block 570. At block 582, the player's cumulative value or number of credits may be updated by subtracting the bet made by the player and adding, if the keno game was won, the payout value determined at block 580. The cumulative value or number of credits may also be displayed in the display area 540 (FIG. 17).

Video Bingo

Figure 20:
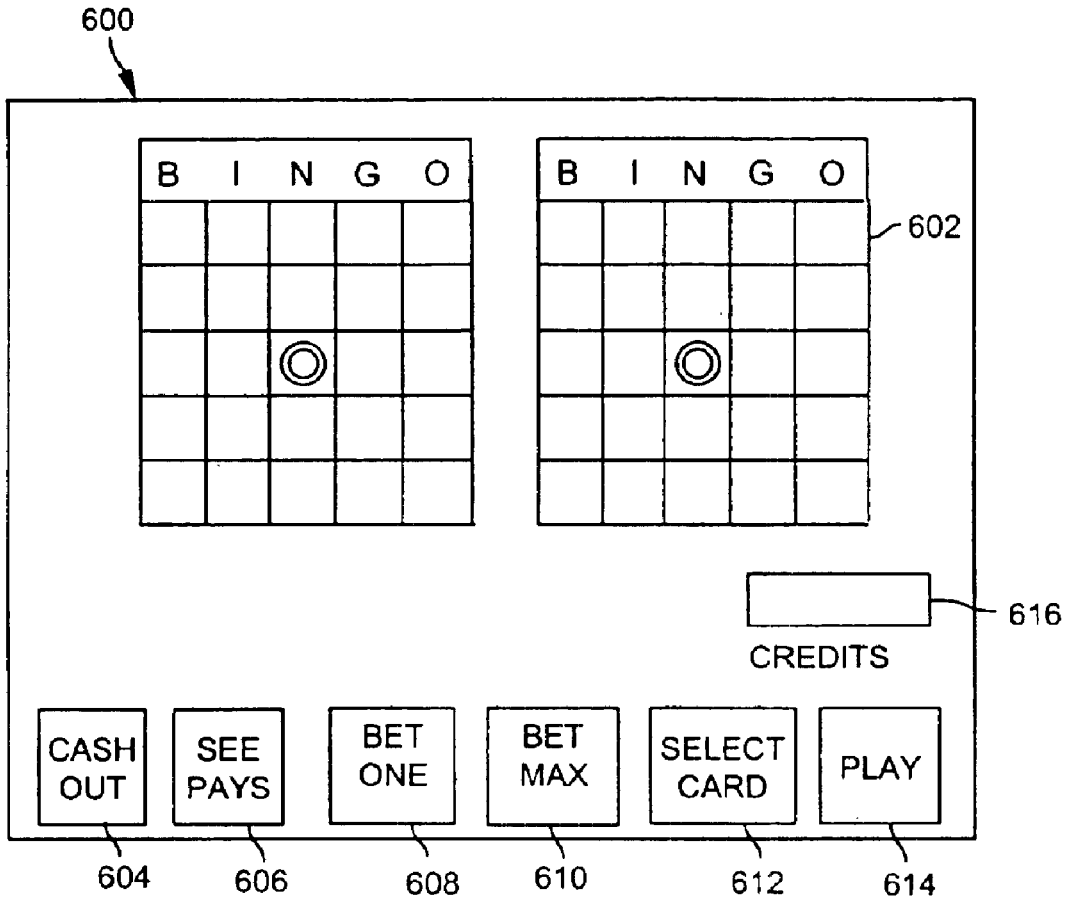
FIG. 20 is an illustration of an embodiment of a visual display that may be displayed during performance of the video bingo routine of FIG. 21.

FIG. 20 is an exemplary display 600 that may be shown on the display unit 70 during performance of the video bingo routine 250 shown schematically in FIG. 10. Referring to FIG. 20, the display 600 may include one or more video images 602 of a bingo card and images of the bingo numbers selected during the game. The bingo card images 602 may have a grid pattern.

To allow the player to control the play of the bingo game, a plurality of player-selectable buttons may be displayed. The buttons may include a "Cash Out" button 604, a "See Pays" button 606, a "Bet One Credit" button 608, a "Bet Max Credits" button 610, a "Select Card" button 612, and a "Play" button 614. The display 600 may also include an area 616 in which the number of remaining credits or value is displayed. If the display unit 70 is provided with a touch-sensitive screen, the buttons may form part of the video display 600. Alternatively, one or more of those buttons may be provided as part of a control panel that is provided separately from the display unit 70.

Figure 21:
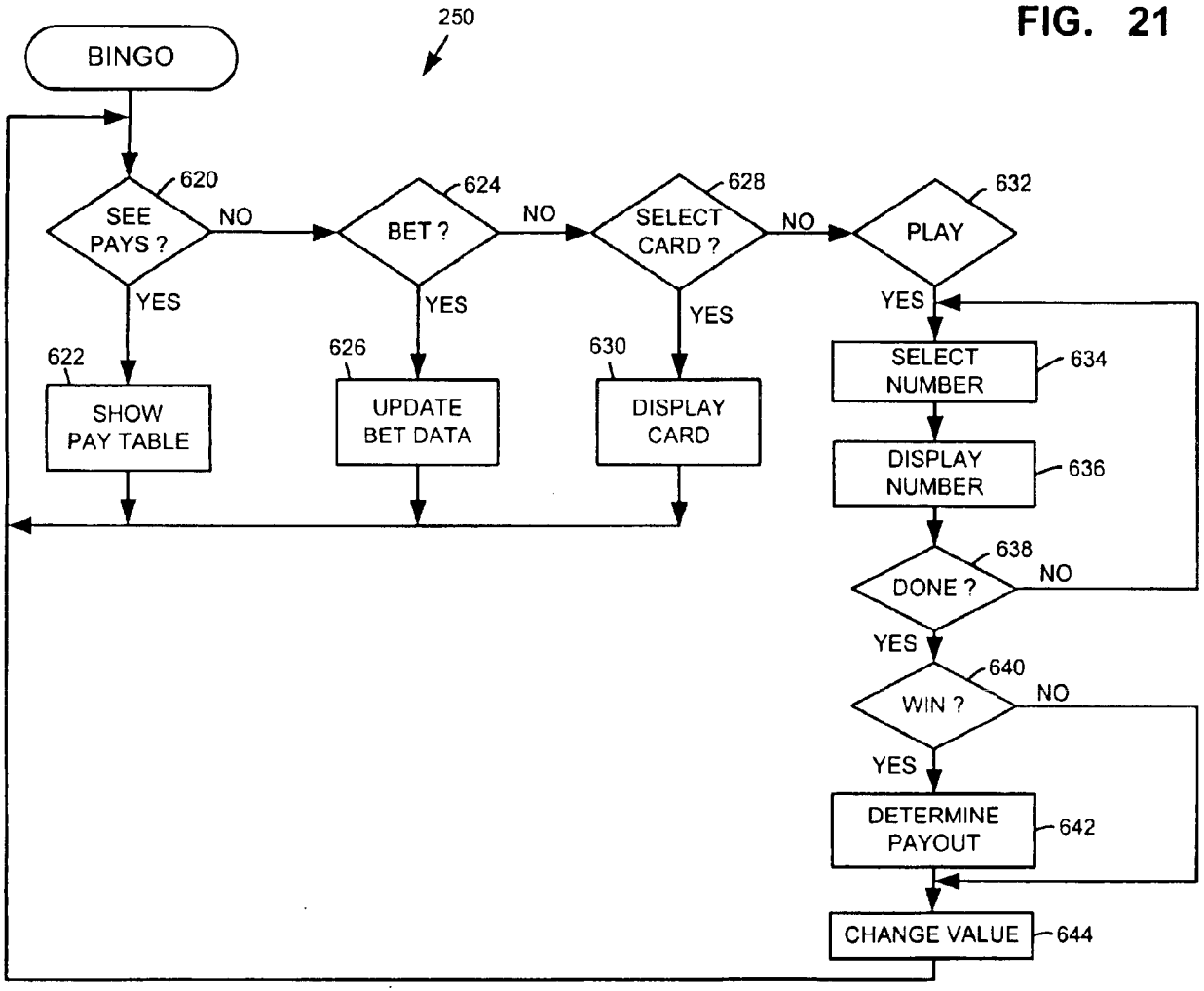
FIG. 21 is a flowchart of an embodiment of a video bingo routine that may be performed by one or more of the gaming units.

FIG. 21 is a flowchart of the video bingo routine 250 shown schematically in FIG. 10. The bingo routine 250 may be utilized in connection with a single gaming unit 20 where a single player is playing a bingo game, or the bingo routine 250 may be utilized in connection with multiple gaming units 20 where multiple players are playing a single bingo game. In the latter case, one or more of the acts described below may be performed either by the controller 100 in each gaming unit 20 or by one of the network computers 22, 32 to which multiple gaming units 20 are operatively connected.

Referring to FIG. 21, at block 620, the routine may determine whether the player has requested payout information, such as by activating the "See Pays" button 606, in which case at block 622 the routine may cause one or more pay tables to be displayed on the display unit 70. At block 624, the routine may determine whether the player has made a bet, such as by having pressed the "Bet One Credit" button 608 or the "Bet Max Credits" button 610, in which case at block 626 bet data corresponding to the bet made by the player may be stored in the memory of the controller 100.

After the player has made a wager, at block 628 the player may select a bingo card, which may be generated randomly. The player may select more than one bingo card, and there may be a maximum number of bingo cards that a player may select. After play is to commence as determined at block 632, at block 634 a bingo number may be randomly generated by the controller 100 or a central computer such as one of the network computers 22, 32. At block 636, the bingo number may be displayed on the display unit 70 and the display units 70 of any other gaming units 20 involved in the bingo game.

At block 638, the controller 100 (or a central computer) may determine whether any player has won the bingo game. If no player has won, another bingo number may be randomly selected at block 634. If any player has bingo as determined at block 638, the routine may determine at block 640 whether the player playing that gaming unit 20 was the winner. If so, at block 642 a payout for the player may be determined. The payout may depend on the number of random numbers that were drawn before there was a winner, the total number of winners (if there was more than one player), and the amount of money that was wagered on the game. At block 644, the player's cumulative value or number of credits may be updated by subtracting the bet made by the player and adding, if the bingo game was won, the payout value determined at block 642. The cumulative value or number of credits may also be displayed in the display area 616 (FIG. 20).

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. An apparatus, comprising:

a gaming apparatus and a player tracking card;

said gaming apparatus comprising a housing, a display unit associated with said housing and capable of generating video images, a value input device, a card reader, and a controller;

said card reader comprising a first light generating source, a second light generating source, and a data reading apparatus, said first light generating source associated with said card reader and adapted to generate light corresponding to a first visible color, and said second light generating source associated with said card reader and adapted to generate light corresponding to a second visible color, said controller operatively coupled to said display unit, said value input device, and said card reader, said controller comprising a processor and a memory operatively coupled to said processor, said controller being programmed to allow a person to make a wager, said controller being programmed to cause a video image to be generated on said display unit, said video image representing a game selected from the group of games consisting of video poker, video blackjack, video slots, video keno and video bingo, said video image comprising an image of at least five playing cards if said game comprises video poker, said video image is an image of a plurality of simulated slot machine reels if said game comprises video slots, said video image is an image of a plurality of playing cards if said game comprises video blackjack, said video image is an image of a plurality of keno numbers if said game comprises video keno, said video image is an image of a bingo grid if said game comprises video bingo, said controller being programmed to determine an outcome of said game represented by said video image and a value payout associated with said outcome of said game;

said player tracking card disposed in said card reader, said player tracking card comprising a data storage device, a first card surface, a second card surface, and a light transmissive body portion, said data storage device adapted to store data representing the identification of a player, and said light transmissive body portion extending between said first card surface and said second card surface;

said player tracking card being positioned in a card illumination position wherein said first card surface is disposed in said card reader so that said first card surface is positioned adjacent said first and second light generating sources associated with said card reader, and said second card surface of said player tracking card remains visible outside said card reader; and when said player tracking card is in said card illumination position, lights generated by said first and second light generating sources are transmitted into said first card surface of said player tracking card and are transmitted through said light transmissive body portion of said player tracking card so that said lights are visible to said user through said second card surface.

2. A gaming system, comprising a plurality of apparatuses as defined in claim 1, said apparatuses being interconnected to form a network of apparatuses.

3. A gaming system as defined in claim 2, wherein said apparatuses are interconnected via the Internet.

4. An apparatus as defined in claim 1, wherein said light generating sources are mounted on a card reader chassis.

5. An apparatus as defined in claim 1, wherein said second card surface of said player tracking card is generally parallel to and spaced apart from said first card surface of said player tracking card.

6. An apparatus as defined in claim 1, wherein said data storage device comprises a magnetic strip.

7. An apparatus as defined in claim 1, wherein said light transmissive body portion comprises a plurality of optic fibers embedded within said player tracking card.

8. An apparatus as defined in claim 1, wherein said player tracking card further comprises a third card surface, a fourth card surface, a fifth card surface, and a sixth card surface, said player tracking card having a reflective material disposed on at least a portion of said third, fourth, fifth, and sixth card surfaces to enhance light transmission from said first card surface to said second card surface.

9. An apparatus as defined in claim 1, wherein said player tracking card further comprises a third card surface, a fourth card surface, a fifth card surface, and a sixth card surface comprising a lower index of refraction than said light transmissive body portion of said player tracking card.

10. An apparatus, comprising:

a gaming apparatus and a player tracking card;

said gaming apparatus comprising a housing, a display unit associated with said housing and capable of generating video images, a value input device, a card reader, and a controller;

said card reader comprising a visible light generating source and a data reading apparatus, said visible light generating source associated with said card reader and adapted to generate light having a wavelength visible to a player, and said controller operatively coupled to said display unit, said value input device, and said card reader, said controller comprising a processor and a memory operatively coupled to said processor, said controller being programmed to allow a person to make a wager, said controller being programmed to cause a video image to be generated on said display unit, said video image representing a casino game, said controller being programmed to determine, after said video image has been displayed, an outcome of said casino game represented by said video image and to determine a value payout associated with said outcome of said casino game; and said player tracking card disposed in said gaming apparatus comprising a data storage device, a first card surface, a second card surface, and a light transmissive body portion, said data storage device adapted to store data representative of the identification of a player;

said light transmissive body portion extending between said first card surface and said second card surface;

said player tracking card being positioned in a card illumination position wherein said first card surface is disposed in said card reader so that said first card surface is positioned adjacent said visible light generating source associated with said card reader, and said second card surface of said player tracking card remains visible outside said card reader; and when said player tracking card is in said card illumination position, visible light generated by said visible light generating source is transmitted into said first card surface of said player tracking card and is transmitted through said light transmissive body portion or said player tracking card so that said visible light is visible to said user through said second card surface.

11. A gaming system, comprising a plurality of apparatuses as defined in claim 10, said apparatuses being interconnected to form a network of apparatuses.

12. A gaming system as defined in claim 11, wherein said apparatuses are interconnected via the Internet.

13. An apparatus as defined in claim 10, wherein said light generating source is mounted on a card reader chassis.

14. An apparatus as defined in claim 10, wherein said data storage device is a magnetic strip.

15. An apparatus as defined in claim 10, wherein said light transmissive body portion comprises an optic fiber embedded within said player tracking card.

16. An apparatus as defined in claim 10, wherein said player tracking card further comprises a third card surface, a fourth card surface, a fifth card surface, and a sixth card surface, said player tracking card having a reflective material disposed on at least a portion of said third, fourth, fifth, and sixth card surfaces to enhance light transmission from said first card surface to said second card surface.

17. An apparatus as defined in claim 11, wherein said player tracking card further comprises a third card surface, a fourth card surface, a fifth card surface, and a sixth card surface comprising a lower index of refraction than said light transmissive body portion of said player tracking card.

18. An apparatus, comprising:

a gaming apparatus and a player tracking card;

said gaming apparatus comprising a housing, a display unit associated with said housing and capable of generating video images, a value input device, a card reader, and a controller;

said card reader comprising a visible light generating source and a data reading apparatus, said visible light generating source associated with said card reader and adapted to generate light in the visible spectrum;

said controller operatively coupled to said display unit, said value input device, and said card reader, said controller comprising a processor and a memory operatively coupled to said processor, said controller being programmed to allow a person to make a wager, said controller being programmed to allow a person to make a payline selection, said controller being programmed to cause a video image to be generated on said display unit, said video image comprising a plurality of simulated slot machine reels of a slots game, each of said slot machine reels having a plurality of slot machine symbols, said controller being programmed to determine an outcome of said slots game represented by said video image and a value payout associated with said outcome of said slots game, said controller being programmed to determine said outcome of said slots game based on a configuration of said slot machine symbols; and said player tracking card disposed in said card reader, said player tracking card comprising a data storage device, a first card surface, a second card surface, and a light transmissive body portion, said data storage device adapted to store data representative of the identification of a player, and said light transmissive body portion forming a light pipe; and said first card surface disposed in said card reader so that at least a portion of said second card surface of said player tacking card remains exposed from said card reader.

19. A gaming system, comprising a plurality of apparatuses as defined in claim 18, said apparatuses being interconnected to form a network of apparatuses.

20. An apparatus as defined in claim 18, wherein said player tracking card being positioned in a card illumination position wherein said first card surface is disposed in said card reader so that said first card surface is positioned adjacent said visible light generating source associated with said card reader to optically couple said visible light generating source to said light pipe such that visible light generated by said visible light generating source is transmitted through said light pipe to said first card surface of said player tracking card; and when said player tracking card is in said card illumination position, visible light generated by said visible light generating source is transmitted through said light pipe and is visible to said player through said second card surface.

21. An apparatus, comprising:

a gaming apparatus and a player tracking card;

said gaming apparatus comprising a housing, a display unit associated with said housing and capable of generating video images, a value input device, a card reader, and a controller;

said card reader comprising a data reading apparatus and an energy transfer apparatus;

said controller operatively coupled to said display unit, said value input device, said card reader, said card reader's data reading apparatus, and said card reader's energy transfer apparatus, said controller comprising a processor and a memory operatively coupled to said processor, said controller being programmed to allow a person to make a wager, said controller being programmed to cause a video image to be generated on said display unit, said video image representing a game selected from the group of games consisting of video poker, video blackjack, video slots, video keno and video bingo, said video image is an image of at least five playing cards if said game comprises video poker, said video image is an image of a plurality of simulated slot machine reels if said game comprises video slots, said video image is an image of a plurality of playing cards if said game comprises video blackjack, said video image is an image of a plurality of keno numbers if said game comprises video keno, said video image is an image of a bingo grid if said game comprises video bingo, said controller being programmed to determine an outcome of said game represented by said video image and a value payout associated with said outcome of said game;

said player tracking card disposed in said card reader, said player tracking card comprising a data storage device, a first card surface, a second card surface, an energy transfer apparatus, and a light generating source, said data storage device adapted to store data representing the identification of a player;

said player tracking card being positionable in a card illumination position wherein said first card surface is disposed in said card reader and said second card surface remains visible outside said card reader;

said player tracking card's energy transfer apparatus positioned to receive energy from said card reader's energy transfer apparatus when said player tracking card is in said card illumination position; and said light generating source connected to receive energy from said player tracking card's energy transfer apparatus, wherein light generated by said light generating source is visible through said second card surface when said player tracking card is in said card illumination position.

22. A gaining system, comprising a plurality of apparatuses as defined in claim 21, said apparatuses being interconnected to form a network of apparatuses.

23. An apparatus as defined in claim 21, wherein said card reader's energy transfer apparatus comprises a coil having at least one loop, and wherein said player tracking card's energy transfer apparatus comprises a coil having at least one loop, so that energy may be inductively transferred from said gaming apparatus to said player tracking card when said player tracking card is in said card illumination position.

24. An apparatus as defined in claim 21, wherein said card reader's energy transfer apparatus comprises a first metallic plate and a second metallic plate, and wherein said player tracking card's energy transfer apparatus comprises a third metallic plate and a fourth metallic plate, so that energy may be transferred from said gaming apparatus to said player tracking card when said player tracking card is in said card illumination position.

25. An apparatus as defined in claim 21, wherein said card reader's energy transfer apparatus comprises a first conductive port, and wherein said player tracking card's energy transfer apparatus comprises a second conductive port to mate with said first conductive port, so that electrical energy is transferred directly from said gaming apparatus to said player tracking card through said first and second conductive ports when said player tracking card is in said card illumination position.

26. An apparatus, comprising:

a gaming apparatus and a player tracking card;

said gaming apparatus comprising a housing, a display unit associated with said housing and capable of generating video images, a value input device, a card reader, and a controller;

said card reader comprising a data reading apparatus and an energy transfer apparatus;

said controller operatively coupled to said display unit, said value input device, said card reader, said card reader's energy transfer apparatus, said controller comprising a processor and a memory operatively coupled to said processor, said controller being programmed to allow a person to make a wager, said controller being programmed to allow a person to make a payline selection, said controller being programmed to cause a video image to be generated on said display unit, said video image comprising a plurality of simulated slot machine reels of a slots game, each of said slot machine reels having a plurality of slot machine symbols, and said controller being programmed to determine an outcome of said slots game represented by said video image and a value payout associated with said outcome of said slots game, said controller being programmed to determine said outcome of said slots game based on a configuration of said slot machine symbols; and said player tracking card disposed in said card reader, said player tracking card comprising a data storage device, a first card surface, a second card surface, an energy transfer apparatus, and a light generating source, said data storage device adapted to store data representing the identification of a player;

said player tracking card being positionable in a card illumination position wherein said first card surface is disposed in said card reader and said second card surface remains visible outside said card reader;

said player tracking card's energy transfer apparatus positioned to receive energy from said card reader's energy transfer apparatus when said player tracking card is in said card illumination position; and said light generating source connected to receive energy from said player tracking card's energy transfer apparatus, wherein light generated by said light generating source is visible through said second card surface when said player tracking card is in said card illumination position.

27. A gaining system, comprising a plurality of apparatuses as defined in claim 26, said apparatuses being interconnected to form a network of apparatuses.

28. A gaming system as defined in claim 27, wherein said gaming apparatuses are interconnected via the Internet.

29. An apparatus as defined in claim 26, wherein said card reader's energy transfer apparatus comprises a coil having at least one loop, and wherein said player tracking card's energy transfer apparatus comprises a coil having at least one loop, so that energy may be inductively transferred from said gaming apparatus to said player tracking card when said player tracking card is in said card illumination position.

30. An apparatus as defined in claim 26, wherein said card reader's energy transfer apparatus comprises a first metallic plate and a second metallic plate, and wherein said player tracking card's energy transfer apparatus comprises a third metallic plate and a fourth metallic plate, so that energy may be transferred from said gaming apparatus to said player tracking card when said player tracking card is in said card illumination position.

31. An apparatus as defined in claim 26, wherein said card reader's energy transfer apparatus comprises a first conductive port, and wherein said player tracking card's energy transfer apparatus comprises a second conductive port to mate with said first conductive port, so that electrical energy is transferred directly from said gaming apparatus to said player tracking card through said first and second conductive ports when said player tracking card is in said card illumination position.

32. An apparatus as defined in claim 26, wherein said player tracking card further comprises a microprocessor.

33. A player tracking card for use in a gaming apparatus programmed to play a game selected from the group of games consisting of video poker, video blackjack, video slots, video keno and video bingo, the gaming apparatus including a housing, a display unit associated with said housing, a value input device, a card reader having a data reading apparatus, an energy transfer apparatus to transmit energy, a controller operatively coupled to said display unit, said value input device, said card reader, said first energy transfer apparatus, and said controller, including a processor and a memory operatively coupled to said processor, said player tracking card comprising:

an on-card energy transfer apparatus;

a data storage device that stores gaming data and data representative of an identification of a player;

a first card surface;

a second card surface spaced apart from and generally parallel to said first card surface; and a light generating source;

said player tracking card being positionable in a card illumination position wherein said first card surface is disposed so that said on-card energy transfer apparatus is positioned to receive transmitted energy; and said light generating source connected to receive energy from said on-card energy transfer apparatus, wherein light generated by said light generating source is visible through said second card surface.

34. A player tracking card as defined in claim 33, wherein said on-card energy transfer apparatus comprises a coil having at least one conductive loop.

35. A player tracking card as defined in claim 33, wherein said on-card energy transfer apparatus comprises a plurality of metallic plates.

36. A player tracking card as defined in claim 33, wherein said on-card energy transfer apparatus comprises a conductive port.

37. A player tracking card as defined in claim 33, wherein said data storage device comprises a magnetic strip.

38. A player tracking card as defined in claim 33, wherein said data storage device comprises a RAM.

39. A player tracking card as defined in claim 33, further comprising an on-card microprocessor.

40. A player tracking card for use in a gaming apparatus programmed to play a game selected from the group of games consisting of video poker, video blackjack, video slots, video keno and video bingo, the gaming apparatus including a housing, a display unit associated with said housing, a value input device, a card reader having a data reading apparatus, an energy transfer apparatus to transmit energy, a first light generating source associated with said card reader and adapted to generate light corresponding to a first visible color, a second light generating source associated with said card reader and adapted to generate light corresponding to a second visible color, a controller operatively coupled to said display unit, said value input device, said card reader, said first energy transfer apparatus, and said controller, including a processor and a memory operatively coupled to said processor, said player tracking card comprising:

a data storage device that stores gaming data and data representative of an identification of a player;

a first card surface;

a second card surface spaced apart from and generally parallel to said first card surface;

a light transmissive body portion comprised of a transparent material;

a third card surface, a fourth card surface, a fifth card surface, and a sixth card surface comprising a lower index of refraction than said light transmissive body portion to enhance light transmission from said first card surface to said second card surface; and said player tracking card being positionable in a card illumination position wherein said first card surface is disposed so that when said lights are applied to said first card surface, both of said lights are visible through said second card surface.

41. A player tracking card as defined in claim 40, wherein said data storage device comprises a magnetic strip.

42. A player tracking card as defined in claim 40, wherein said data storage device comprises a RAM.

43. A player tracking card as defined in claim 40, further comprising an on-card microprocessor.

44. A player tracking card for use in a gaming apparatus programmed to play a game selected from the group of games consisting of video poker, video blackjack, video slots, video keno and video bingo, the gaming apparatus including a housing, a display unit associated with said housing, a value; input device, a card reader having a data reading apparatus, a first energy transfer apparatus to transmit energy, a visible light generating source to generate visible light, a controller operatively coupled to said display unit, said value input device, said card reader, said first energy transfer apparatus, and said visible light generating source, and said controller, including a processor and a memory operatively coupled to said processor, said player tracking card comprising:

a data storage device that stores gaming data and data representative of an identification of a player;

a first card surface;

a second card surface spaced apart from and generally parallel to said first card surface;

a body portion comprising a plurality of embedded optic fibers extending between said first card surface and said second card surface; and said player tracking card being adapted to be positioned in a card illumination position wherein said first card surface is disposed so that when visible light is applied to said first card surface, the visible light is selectively transmitted through at least one of said plurality of embedded optic fibers and is visible through said second card surface.

45. A player tracking card as defined in claim 44, wherein said data storage device comprises a magnetic strip.

46. A player tracking card as defined in claim 44, wherein said data storage device comprises a RAM.

47. A player tracking card as defined in claim 44, further comprising an on-card microprocessor.

* * * * *

UNITED STATES PATENT AND TRADEMARK OFFICE

CERTIFICATE OF CORRECTION

PATENT NO. : 6,890,260 B2
DATED : May 10, 2005
INVENTOR(S) : Richard Ollins

It is certified that error appears in the above-identified patent and that said Letters Patent is hereby corrected as shown below:

Column 21,
Line 68, please delete the phrase "visible color," and insert -- visible color; and --.

Column 26,
Line 5, please delete the phrase "A gaining system," and insert -- A gaming system, --.

Column 27,
Line 15, please delete the phrase "A gaining system" and insert -- A gaming system, --.

Column 29,
Line 3, please delete the phrase "a value; input device," and insert -- a value input device, --.

Signed and Sealed this

Twenty-seventh Day of September, 2005

JON W. DUDAS
*Director of the United States Patent and Trademark Office*